US011125038B2

(12) United States Patent
Hejleh et al.

(10) Patent No.: US 11,125,038 B2
(45) Date of Patent: Sep. 21, 2021

(54) DOWNHOLE SURVEYING AND CORE SAMPLE ORIENTATION SYSTEMS, DEVICES AND METHODS

(71) Applicant: Globaltech Corporation Pty Ltd, Canning Vale (AU)

(72) Inventors: Khaled Hejleh, Peppermint Grove (AU); Gordon Stewart, Claremont (AU); Brett James Wilkinson, Wembley Downs (AU); Michael Alan Klass, Winthrop (AU); Johan Anwar, Kalamunda (AU)

(73) Assignee: Globaltech Corporation Pty Ltd, Forrestfield (AU)

( * ) Notice: Subject to any disclaimer, the term of this patent is extended or adjusted under 35 U.S.C. 154(b) by 95 days.

(21) Appl. No.: 16/101,407

(22) Filed: Aug. 11, 2018

(65) Prior Publication Data

US 2018/0363398 A1 Dec. 20, 2018

Related U.S. Application Data

(62) Division of application No. 14/381,215, filed on Aug. 27, 2014, now Pat. No. 10,066,455.

(51) Int. Cl.
*E21B 25/16* (2006.01)
*E21B 44/00* (2006.01)
(Continued)

(52) U.S. Cl.
CPC ..... *E21B 25/16* (2013.01); *E21B 44/00* (2013.01); *E21B 47/06* (2013.01); *E21B 47/12* (2013.01)

(58) Field of Classification Search
CPC ..... E21B 25/02–25/18; E21B 47/022; E21B 47/09
See application file for complete search history.

(56) References Cited

U.S. PATENT DOCUMENTS 6,400,646 B1 * 6/2002 Shah ..... E21B 47/16 367/82
7,296,638 B2 * 11/2007 Beach ..... E21B 25/16 175/44

(Continued)

FOREIGN PATENT DOCUMENTS

AU 2008229644 B2 3/2008
WO 2008113127 A1 9/2008

*Primary Examiner* — Steven A MacDonald
(74) *Attorney, Agent, or Firm* — Charles H. Jew

(57) ABSTRACT

A method and system of validating orientation of a core obtained by drilling the core from a subsurface body of material, the method including: a) determining that vibration from drilling is below a nominated level, b) recording data relating to orientation of the core to be retrieved, the data recorded using a downhole core orientation data recording device, c) separating the core from the subsurface body, and d) obtaining from the core orientation data recording device an indication of the orientation of the core based on the recorded data obtained when the vibration from drilling was below the nominated level and before the core was separated from the subsurface body. A method of determining orientation of a core sample obtained by drilling from aboveground into a subsurface body includes recording data relating to a core sample being obtained by the drilling when vibration from drilling is below a threshold; providing an input to a user operated communication device; the communication device identifying a time of the user input to the communication device; retrieving the data gathering device and core sample; communicating between the communication device and the retrieved data gathering device; determining from indications provided by the retrieved data gathering device an orientation of the core sample.

17 Claims, 13 Drawing Sheets

(51) Int. Cl.
*E21B 47/06* (2012.01)
*E21B 47/12* (2012.01)

(56) References Cited

U.S. PATENT DOCUMENTS

| | | | | |
|---|---|---|---|---|
| 2004/0020063 | A1* | 2/2004 | Lewis | E21B 47/01 33/313 |
| 2004/0051650 | A1* | 3/2004 | Gonsoulin | G01V 11/002 340/853.1 |
| 2005/0034894 | A1* | 2/2005 | Beach | E21B 47/024 175/44 |
| 2007/0282533 | A1* | 12/2007 | Parfitt | E21B 47/026 702/2 |
| 2009/0159335 | A1* | 6/2009 | Cravatte | E21B 49/02 175/40 |
| 2010/0000108 | A1* | 1/2010 | Stockton | E21B 47/00 33/501.02 |
| 2011/0253452 | A1* | 10/2011 | Beuershausen | E21B 25/00 175/58 |
| 2012/0018220 | A1* | 1/2012 | Parfitt | E21B 25/16 175/44 |
| 2012/0037421 | A1* | 2/2012 | Parfitt | E21B 25/16 175/44 |
| 2012/0176251 | A1* | 7/2012 | Klass | E21B 44/00 340/854.6 |
| 2018/0363398 | A1* | 12/2018 | Hejleh | E21B 47/12 |

* cited by examiner

DOWNHOLE SURVEYING AND CORE SAMPLE ORIENTATION SYSTEMS, DEVICES AND METHODS

REFERENCE TO RELATED APPLICATIONS

This application is a divisional patent application of U.S. patent Ser. No. 14/381,215 which was filed on Aug. 27, 2014, and which is incorporated herein by reference.

FIELD OF THE INVENTION

The present invention relates to improvements to systems, devices and methods for conducting downhole surveying and determining the orientation of a core sample relative to a body of material from which the core sample has been obtained.

The present invention further relates to a device, system and method for use in marking orientation of a core sample.

BACKGROUND TO THE INVENTION

As part of mining/oil & gas exploration activities, as well as extracting rock samples for construction/civil engineering, there is a need to obtain underground 'core' samples for analysis by geologists.

Core orientation is the process of obtaining and marking the orientation of a core sample from a drilling operation. The orientation of the sample is determined with regard to its original position in a body of material, such as rock or ore deposits underground.

Such core samples are obtained by drilling into an underground medium, such as sedimentary rock, and extracting a solid cylindrical core which reveals, amongst other things, the type of rock, rock strata, presence or absence of minerals or other deposits, and any veins of useful deposits. Core samples can be correlated against each other to reveal trends in rock strata and deposits, which help predict whether mining is worthwhile, and if so, where, in what direction and how deep below the surface.

In order to obtain required information from the extracted core samples, a core orientation device is attached between a greater unit and an inner core tube holding the core sample. The purpose of the core orientation device is to measure and log the orientation of the core with respect to the 'downside' of the underground location from which it has been extracted. This is an important process as these core samples are used to build a three dimensional profile of existing subsurface resource deposits, such as iron ore or diamonds. If a valuable ore seam is found, it is vital that the core is orientated properly so that a true picture of the ore body can be developed underground.

Whilst depth and azimuth are used as important indicators of core position, they are generally inadequate on their own to determine the original position and attitude of subsurface geological features. Core orientation enables such details to be determined.

Orientation of the core sample needs to be obtained from a drilling operation. The orientation of the sample is determined with regard to its original position in a body of material, such as rock or ore deposits underground. Core orientation i.e. which side of the core was facing the bottom (or top) of a borehole and rotational orientation compared to surrounding material, enables such details to be determined.

Core samples are cylindrical in shape, typically around 3 metres long, and are obtained by drilling with an annular hollow core drill into subsurface material, such as sediment and rock, and recovering the core sample. A diamond tipped drill bit is used at the end of the hollow drill string. As the drill progresses deeper, more sections of hollow steel drill tube are added to extend the drill string. An inner tube assembly captures the core sample. This inner tube assembly remains stationary while the outer tubes rotate with the drill bit. Thus, the core sample is pushed into the inner tube.

Once retrieved to the surface, the core end is subsequently marked to indicate orientation of the core sample.

Current practice involves the core orientation being recorded during drilling, and analysis is undertaken during core logging. The core logging process requires the use of systems to measure the angles of the geological features, such as an integrated core logging system.

Through core orientation, it is possible to understand the geology of a subsurface region and from that make strategic decisions on future mining or drilling operations, such as economic feasibility, predicted ore body volume, and layout planning. In the construction industry, core orientation can reveal geological features that may affect siting or structural foundations for buildings.

Typical systems and methodologies presently used periodically record orientation of the core between commencement and end of drilling. Vibration from drilling causes many recorded orientation results to be inaccurate or not needed because orientation before end of drilling is not required or used. This needless recordal of data wastes the limited power of the onboard battery powering the orientation sensors, and thereby limits the amount of time an orientation unit can remain downhole before needing a recharge or battery replacement.

Apart from analyzing this content of the core sample, it is also necessary to determine the 'orientation' of the core(s) with respect to the drilling angle and depth from the earth's surface and the direction of rotation of the core, at the source of extraction. These measurements are used as an aid in determining the consistency and direction of deposits, such as ore content, and for producing a 3D 'picture' of underground mineralization.

After retrieving the core sample to the surface, the core orientation device will then be used to electronically or mechanically determine the core's orientation before being drilled out. The operator would have to rotate the whole inner tube so as to position the core tube such that the core is set in an up/down position in the core tube. This gives a correct reference for the original orientation of the material in the core when it was attached to the ground material prior to extraction. The core sample end is then visually marked to show the correct up/down orientation for later analysis.

It has been realised that the methodology of obtaining the desired orientation of the core representative of the point at which the core was 'broken' away from the body from which it is drilled could be improved.

To this end, it has been found desirable of the present invention to provide a method and system of obtaining an indication of core orientation that reduces power demand on the orientation unit and avoids the need to record orientation data that is not needed. This aims to simplify and speed up the core orientation data gathering process.

Core orientation is recorded during drilling, and analysis is undertaken during core logging. The core logging process requires the use of systems to measure the angles of the geological features, such as an integrated core logging system.

Through core orientation, it is possible to understand the geology of a subsurface region and from that make strategic decisions on future mining or drilling operations, such as economic feasibility, predicted ore body volume, and layout planning. In the construction industry, core orientation can reveal geological features that may affect siting or structural foundations for buildings In a drill string, a 'back end' assembly connects to a greaser. This greater lubricates the back end assembly which rotates with the outer casing while the greater remains stationary with the inner tubing.

Once a core sample is cut, the inner tube assembly is recovered by winching to the surface. After removal of the back end assembly from the inner tube assembly, the core sample is recovered and catalogued for analysis.

Various core orientation systems have previously been used or proposed. Traditional systems use a spear and clay impression arrangement where a spear is thrown down the drill string and makes an impression in clay material at an upper end of the core sample. This impression can be used to vindicate the orientation of the core at the time and position the spear impacted the clay.

A more recent system of determining core oprientation is proposed in Australian patent number 2006100113 (also as U.S. Pat. No. 7,584,055). This patent document describes a core orientation device for a core drill. The device provides signals associated with a physical orientation of a core orientation device for a particular moment in time. The device includes a memory for storing and providing the orientation data when required. The system described in AU 2006100113 provides a two unit replacement for the greater described above. A first orientation system unit houses electronics and a battery used to record orientation data, and the second greater unit is an extended greater accommodating a physical screw on connector for the first unit as well as serving as the greaser. This combination forms part of the inner tube assembly with the core tube, orientation system 'first' unit and the connector/greaser 'second' unit. However, as a result of the now extended length of the combined orientation system and greater units compared with a standard greater only unit, the outer drill string casing now requires a matching extension piece to extend the outer casing an equal amount. The core orientation system has a display on one face which is used when setting up the unit prior to deployment, and to indicate core sample alignment when the core sample is recovered. At the surface before removing the core sample from the inner tube assembly, the operator views the display fitted on the system. The display indicates for the operator to rotate the unit and the sample within the tube until the whole core tube and sample is oriented with the lower section of the core sample at the lower end of the tube. The core sample is marked (usually by pencil) before being removed from the core for future analysis.

However, the device described in AU 2006100113 has been found to have certain limitations. The orientation unit is connected to the greater by a screw thread and o-ring seal arrangement. In the harsh down hole environment within the drill string, it has been realised that the o-ring seals are not always effective and can let fluid into the space between the orientation unit and the greaser. The display unit allows fluid into the electronics of the orientation, resulting in a risk of fault or failure of the device. Furthermore, the orientation unit must be disassembled from the greater unit before the display and orientation unit can be viewed, rotated and the required core orientation displayed. Thus, the device of AU 2006100113 requires manual manipulation before any reading can be viewed on the display, if the display and the electronics have survived any ingress of fluid past the o-ring seal.

Furthermore, a problem has been identified in the known art. Battery powered downhole survey equipment, such as probes and core orientation units, are typically switched on at the surface and run almost continuously or operate on a frequent timer basis. For example, a known core orientation device the subject of Australian patent application AU 2010200162 takes measurements determined by a timer whether or not the values obtained are worthwhile or accurate. This leads a large amount of unusable data which is typically discarded and such continuous or too often recording of data unnecessarily rapidly reduces battery life of the downhole device. Such known arrangements may only last a few weeks or months before the downhole device needs recharging or replacing. Often spare equipment is held on hand just in case the batter fails. This leads to far too much equipment being needed, at an increased cost to the drilling operator. It would be beneficial to reduce reliance on holding spare equipment on hand.

In addition, it has been realised that, during the drilling process, if sections of fragmented earth are drilled into (resulting in fractured core samples) then the inner tube can rotate. Furthermore, vibrations caused by drilling have also been identified as a cause of inaccurate data.

Also, it has been realised that only a limited amount of downhole data is actually required in order to later determine correct orientation of a core sample at the surface. It has been realised that data recording on a continuous or frequent periodic basis whilst drilling is occurring is unnecessary. Only down orientation of the core sample needs to be known, and provided data relating to the down orientation can be identified and referenced to a particular known time, core orientation can be determined.

It has therefore been found desirable to provide improved downhole data recording through a system, device and method that alleviates one or more of the aforementioned problems whilst facilitating more reliable data recovery.

After retrieving the core sample to the surface, the core orientation device will then be used to electronically or mechanically determine the core's orientation before being drilled out. The operator would have to rotate the whole inner tube so as to position the core tube such that the core is set in an up/down position in the core tube. This gives a correct reference for the original orientation of the material in the core when it was attached to the ground material prior to extraction.

Personnel then physically 'mark' the lower end position of that core sample end face protruding from the core tube with a wax pencil or similar marker (usually a red wax pencil). In order to accurately mark the 'lower end' of the core face, a device is used to determine the position to mark the core. This is usually achieved with the aid of spirit-level v-block devices to determine the position to place the 'lower-end' mark on the core face.

This procedure, although straightforward, is often carried out incorrectly, leading to incorrect marking of the orientation of the core. This error is often due to insufficient training, lack of understanding due to language barriers, operator fatigue, ineffectually carrying out of the procedure or basic v-groove spirit level devices not being used correctly or their correct use not being easily understood.

Incorrect marking of the core orientation through human error leads to poor geophysical analysis and results. It has been found that geologists, on realising the marking error, have needed to search through core samples and determine the correct orientation. This loses many man hours of work in having to go back through the original core samples and identify the correct orientation, and until this is done, further development of the worksite cannot be accurately carried out. Mining may commence or continue in the wrong place and/or may miss the vein of resource.

With the aforementioned in mind, it is desirable of the present invention to provide improved means and way by which core sample orientation can be accurately marked.

SUMMARY OF THE INVENTION

With the aforementioned in mind, in one aspect the present invention provides a method of validating orientation of a core obtained by drilling the core from a subsurface body of material, the method including: a) determining that vibration from drilling is below a nominated level, b) recording data relating to orientation of the core to be retrieved, the data recorded using a downhole core orientation data recording device, c) separating the core from the subsurface body, and d) obtaining from the core orientation data recording device an indication of the orientation of the core based on the recorded data obtained when the vibration from drilling was below the nominated level and before the core was separated from the subsurface body.

Preferably the core orientation data recording device activates from a standby mode after detecting that vibration from drilling is at or below the nominated level. The nominated level may coincide with no drilling occurring—to indicate that the core has been received in the inner core tube by drilling. The core orientation data recording device may then determine an indication of core orientation. The core may then be separated from the body of material.

An alternative form of the present invention provides a method of recording core orientation data from a drilling operation when obtaining a core from a subsurface body of material, the method including: determining that drilling has ceased for a period of time, using a downhole core orientation data recording device to record data relating to orientation of the core to be retrieved, separating the core from the subsurface body, retrieving the core to the surface, and obtaining from the core orientation data recording device an indication of the orientation of the core based on the recorded data obtained once the drilling had ceased and before the core was separated from the subsurface body.

When drilling has ceased is preferably the end of drilling immediately prior to obtaining the core. That is, recording the data relating to orientation of the core is obtained preferably after final drilling has been completed prior to obtaining the next core sample.

Preferably no further data relating to core orientation is obtained after separating the core from the subsurface body. This confirms that no further data is required in order to identify (and subsequently mark) the required correct orientation of the core for later analysis of the core.

Once drilling has ceased, a predetermined time interval may elapse before the core is separated from the subsurface body.

Alternatively, or in addition, a predetermined time may elapse after drilling has ceased until the core orientation data is obtained and then the core is subsequently separated from the subsurface body of material. Consequently, the core may be separated from the subsurface body at any instance after the data is recorded provided the drilling does not recommence before the core is separated. If drilling recommences, the drilling must cease for a period of time and fresh orientation data is obtained before the core is separated.

For clarity, the core orientation device does not orientate the core, rather, it records signals indicative of the orientation of the core to be retrieved. Core orientation device and core orientation data recording device are the same in this description.

Preferably any core orientation data samples obtained during drilling or at intervals between periods of drilling are not used, or are disregarded, when determining orientation of the core.

When the drilling ends and the operator is ready to separate the core, preferably a predetermined period of time when there is no drilling is allowed to elapse before the core is separated. The predetermined period may be 10 seconds or more of no drill rotation. Preferably that period does not exceed 90 seconds.

In addition to core orientation, dip measurement may be obtained during the period of drilling 'silence' i.e. when drilling has ceased prior to separating the core.

The core may be separated from the subsurface body by breaking, such as by a strong sharp pull back of the inner tube of the drilling assembly. The operation of breaking the core should take less than 1 minute, preferably less than 30 seconds and more preferably between 10 seconds and 30 seconds.

After separating the core from the subsurface body, a period of time elapses without any further drilling or rotation, or retrieval of the drilling assembly occurring. This period is preferably greater than 90 seconds.

The core orientation device may be sensing for presence or absence of vibration from drilling (or both sensing and recording), and preferably determining whether core orientation data is obtained during a first period when there is no drilling, and preferably determining when the core sample is separated (by detecting related vibration(s)), and preferably determining that the second period of no drilling has occurred after the core separation. The purpose of these timings is to identify the correct 'signature' of 1) no drilling vibration, 2) separation (breaking) of the core, and 3) no drilling. Preferably, if one of these criteria is not met then the data sample or the core sample obtained will be disregarded.

Separation of the core from the subsurface body of material may be determined by detecting acceleration, change of acceleration, or detecting tension or strain, or change in tension or strain, or combinations thereof, resulting from a force applied to the core and the core separating from the subsurface body.

Alternatively, the period of time immediately preceding separation may be determined by a change in the total pressure surrounding the core orientation device or a change in differential pressure between the outside and inside of the core tube, or a predetermined pressure level being reached or exceeded either as a differential pressure or total pressure.

The force may be applied by pulling backwards (in the Z direction back up the borehole) the inner tube holding the core. This can be achieved by an overlock assembly being attached to the backend assembly associated with the inner tube and core.

The Z direction is taken to be the direction of the borehole or drill hole. X and Y directions define planes or directions orthogonal to the Z direction i.e. at right angles to the linear direction of the borehole.

Acceleration or change of acceleration (jerk) may be termed negative acceleration because the force applied tries to pull the core in the direction back up the borehole.

Acceleration or change in acceleration is detected by at least one accelerometer provided within the core orientation data recording device. A three axis accelerometer (X,Y,Z directions) may be used. As mentioned above, acceleration or change in acceleration detected may be in a Z direction in line with an advancing drilling activity i.e. the linear direction of the borehole.

Tension or strain or change in tension or strain may be detected by at least one strain gauge within or on a portion of the downhole equipment associated with obtaining the core. At least one strain gauge may be provided within or on the core orientation data recording device or within or on a section of drill tube. The at least one strain gauge may be electrically connected to the core orientation data recording device.

Change in total pressure within, or presence or change of a pressure differential between the interior and exterior of, the inner core tube can be detected by at least one pressure sensor. The at least one sensor may be provided within or on, or both, the core orientation data recording device and/or within a section of the inner tube assembly. Pressure above a threshold may be detected.

At least one of the at least one pressure sensor may be electrically or optically connected to the core orientation data-recording device.

The change or presence of the pressure may be used to determine a point at which the core should be separated from the subsurface body of material. For example, a pressure measurement or change in pressure may be used to determine that the inner core tube is full or nearly full of core and it is time to retrieve the core. In which case, drilling can cease, the core orientation data recording device can take measurements (such as of core orientation position, gravitational field direction and strength, magnetic field direction and strength etc.) and the core can then be separated from the subsurface body.

One or more forms of the present invention may be provided by a system including at least a core orientation data recording device and a core drilling assembly. Preferably the system includes a remote communication device configured to communicate with the core orientation data recording device to identify a required orientation of the core.

The core orientation data recording device may include at least one visual indicator to show one or more of a direction to rotate the core to obtain the required orientation or a visual indication to show the required orientation.

With the aforementioned in view, at least one form of the present invention provides a method of determining orientation of a core sample obtained by drilling from aboveground into a subsurface body, the method including:

a) operating a downhole data gathering device to detect when vibration from drilling is below a threshold;
b) recording data relating to a core sample being obtained by the drilling when vibration from drilling is below the threshold;
c) providing an input to a user operated communication device;
d) the communication device identifying time of the user input to the communication device;
e) retrieving the data gathering device and core sample;
f) communicating between the communication device and the retrieved data gathering device;
g) determining from indications provided by the retrieved data gathering device an orientation of the core sample.

Obtaining data when vibration from drilling is below a threshold, preferably when there is no drilling and therefore no vibration from drilling at all, enhances reliability and accuracy of the data. For example, magnetic, gravity and inclination values have been found to be more accurately when no drilling is occurring. Drilling activity can cause inaccuracies in the data. This results in multiple data sets saved in known devices simply being unusable. Processing unusable data within the survey probe or externally (such as by experts assessing the data) is uneconomical and a waste of time, money and resources. Also, and of great benefit, the data gathering device can 'go to sleep' in a standby mode while drilling is occurring and no data is being collected. This greatly enhances battery life in the data gathering device. By only waking to take sampling shots when no vibration is detected, the present invention greatly increase battery life.

The communication device may use an internal clock or timer to 'mark' or identify a user input. For example, the user input may commence a timing period of an internal clock or timer.

The input to the communication device, such as a user operating one or more buttons or touch screen controls, on the communication device may include one or more of; an indication of a most recent occurrence when drilling ceased; an indication immediately prior to separating the core sample from the subsurface body and/or an indication after separating the core sample from the subsurface body.

The communication device may be used to activate/deactivate the data gathering device, such as to cease gathering data.

The data gathering device may be used to provide survey data to the communication device or another receiver, the survey data being or derived from recorded data obtained when the no vibration had been detected.

The data gathering device may be operated to provide to the communication device survey data relating to recorded data obtained prior to a defined period of time.

The defined period of time may be provided to the retrieved data gathering device from the communication device.

The defined period of time may be used by the data gathering device to identify recorded data obtained during surveying at a time prior to the amount of the defined time.

Identified recorded data provided as survey data to the communication device or other receiver may be from recorded data recorded by the data gathering device at a period in time closest to the time prior to the amount of defined time than any other recorded data event.

The data gathering device may be operated to detect that vibration is occurring and to therefore wait until a subsequent no vibration event occurs before recording data.

The data gathering device may be employed to detect multiple consecutive survey values during a period of no vibration.

Acceptable recorded data may be identified with a timestamp relating to real time.

A further aspect of the present invention provides a system for use in determining orientation of a core sample obtained by drilling from aboveground into a subsurface body, the system including a data gathering device arranged and configured with control means to detect when vibration from drilling is below a threshold, and activation means to cause the data gathering device to record data during the period of vibration below the threshold.

Downhole survey equipment that 'goes to sleep' when it would otherwise record data that is unnecessary to collect or not worthwhile collecting because of inaccuracies greatly saves on battery power and therefore lengthens the life of the downhole device before the battery needs replacing or recharging. This means that high value (cost and functional value) equipment can remain in use in the field when known equipment would otherwise need replacing. This can avoid the need to hold multiple pieces of battery powered survey equipment on hand just in case one loses power.

Preferably the threshold it set at no vibration from drilling.

Vibration from drilling results from the drill bit cutting into the subsurface body to advance the drill string and from rotation of the drillstring tube.

The data gathering device including a timer providing a timestamp for recorded data events.

Preferably, when drilling stops and vibration is detected to be below the threshold, the data gathering device activates (wakes from standby) and records core orientation data (takes a core orientation 'shot'). The core is then broken from its connection with the ground (no further drilling being required). The core sample can be separated from the ground to which it is connected by yanking or jerking axially along the axis of the drill string.

One or more forms or embodiments of the present invention provides or includes a method whereby, when drilling is stopped;

a) the data gathering device records core orientation data;
b) the core is subsequently separated from its connection with the ground;
c) the communication device signals to the data gathering device to identify the recorded core orientation data that was immediately prior to separating the core sample from the ground; and
d) using that recorded core orientation data to identify orientation of the core sample.

A communication device as part of the system includes communication means arranged and configured to communicate a time value to the data gathering device, the data gathering device including processing means which determines from the received time value the closest recorded data obtained immediately prior to a time determined by subtracting the received time value from a current time value.

The current time value (preferably a real time value or a time quantity) may be provided by the communication device to the data gathering device.

An alternative aspect of the present invention provides a method of obtaining downhole survey data in a borehole created by drilling, the method including advancing a data gathering device into the borehole, the data gathering device determining that vibration is below a predetermined threshold, bringing the data gathering device out of a standby mode during a period when vibration is determined to be below the threshold, recording data during the period, returning the data gathering device to a standby mode when vibration is determined to be above the threshold or sufficient said data has recorded.

Thus, a preferred concept of reducing power consumption in downhole survey tools is realised. A standby, or low power mode, reduces power consumption to a minimum while vibration is detected to be above a threshold limit.

An alternative aspect of the present invention provides a method of determining selection of downhole survey or core orientation data of a respective downhole survey or core orientation device, the method including;

a) providing a data recorder, the recorder arranged to record data relating to downhole surveying or core sample orientation;
b) providing a communication device remote from the data recorder, the communication device having a timer and remaining at a ground surface when the data recorder is below ground;
c) commencing timing with the timer;
d) operating the data recorder to record one or more data events whilst downhole;
e) subsequent to communication device commencing the timing, signalling to the data recorder to provide or identify a recorded data event, the recorded data event being determined by the communication device to be a predetermined period of time prior to the signalling to the data recorder.

Thus, the communication device, which may also be termed a communication device, and the data recorder, which may also be termed a data gathering device, are not time synchronised to each other, and yet the data recorder can be interrogated to provide a required data set or record from a set period time prior to being signalled. For example, the communication device, with its own timer running, may be used to 'mark' a specific moment. At this stage, the data recorder has its own timer running, unsynchronised to the timer of the data recorder. A period of time after the 'mark' recorded, the communication device signals to the data recorder to identify or note a data set or record previously recorded a set period of time ago. The data recorder then checks its memory for the recorded data set or record closest to the end of the set period of time that the communication device has signalled to the data recorder to look back.

A further aspect the present invention provides a core sample orientation system configured to provide an indication of the orientation of a core sample relative to a body of material from which the core has been recovered, the system including a hermetically sealed core sample orientation data gathering device deployable as part of a downhole core sample assembly.

Communication means may be arranged to communicate obtained core sample orientation data to a remote orientation data indication display device having an orientation data display.

A further aspect of the present invention provides a hermetically sealed core sample orientation data gathering device when deployed as part of a core sample orientation system for providing an indication of the orientation of a core sample relative to a body of material from which the core has been extracted.

The orientation data gathering device may include communication means for providing core sample orientation data to a remote orientation data electronic device having an orientation data display.

Thus, the orientation data gathering device of the present system being hermetically sealed avoids risk of ingress of liquid when the downhole, thereby leading to more reliable data gathering operations without the need to recover the device prematurely in order to repair or replace a faulty device, or risk completing a core sampling operation but find at the surface that no data can be recovered and the core orientation cannot be accurately determined.

The orientation data gathering device may be connected to a standard greater unit, thereby allowing known equipment to be used and avoiding the need for specialised greater to be adopted. Because the orientation data gathering device is hermetically sealed to ensure no liquid gets in to the device when deployed downhole, and the device has communication means to send data signals to a remote display, no o-ring seal to the greater is required. This saves on unreliable o-ring seals, reduces risk of damage through water ingress and loss of data, as well as the time saved in not having to recover the damaged device and redeploy a replacement.

The system may further include timer means to commence multiple time intervals for the device to obtain orientation data. A time interval may be synchronised at an orientation reading time and the time interval related to a predetermined time interval. This may be achieved by use of the remote orientation data electronic communication device. System start up, setup, stop and data recovery functions may be carried out using the remote orientation data electronic communication device to operate the orientation data gathering device.

The orientation data gathering device may have one or more visual indicators to show an operator one or more required directions of rotation of a recovered core sample assembly for determining orientation of the core sample, and once a required core sample orientation has been established, the remote orientation data electronic communication device may interrogate the orientation data gathering device to obtain orientation data.

Communication between the orientation data gathering device and the remote orientation data electronic communication device is by wireless communication, such as infra red communication.

The remote orientation data electronic communication device may include a display to show visual information relating to the obtained orientation data, such as an indication that sufficient data has been obtained, that the data is correctly and safely stored and/or that data has been transferred from the orientation data gathering device to the remote orientation data electronic communication device.

The orientation data gathering device may include one or more visual and/or audible indicators relating to a direction of rotation of the device when determining core sample orientation and/or when a required core sample orientation has been determined. For example, illuminated indicators may be provided on the device, such as on an end of the exposed when the greater is removed. However, the greater does not have to be removed, as the light can actually be seen through the existing holes in an off the shelf greaser. A particular colour, number of lights or direction indication may illuminate to indicate that the device and the core sample need rotating in one direction, and a different colour, number of lights or direction indication may illuminate to show an opposite rotation direction is needed. These may be augmented by or replaced by audible indications, such as respective numbers of 'bleeps'. An illuminated and/or audible indication may be given when a required core sample orientation is achieved. For example, both direction lights or audible signals may be given at the same time.

The remote orientation data communication device may also give an indication of the required direction of rotation and/or required core sample orientation.

The remote orientation data communication device may include or be a handheld unit. This unit may include a battery for power, which may be a rechargeable battery.

A further aspect of the present invention provides a method of obtaining core sample orientation data, the method including:

a) deploying a core sample orientation data gathering device as part of a core sample gathering system;
b) obtaining a core sample from a subsurface body of material using the apparatus;
c) using the orientation data gathering device to determine the orientation of the core sample relative to the subsurface body of material; and
d) using a remote communication device to obtain from said orientation data gathering device data relating to the orientation of the core sample.

The method may further include hermetically sealing the core sample orientation data gathering device prior to deployment.

Following recovery of the device, core orientation indications may be given by one or more illuminated and/or audible indications. Coloured indications may be used to determine a required orientation of the core sample. For example, the orientation data gathering device may include lights, such as LEDs, whereby an indication is given to rotate the core sample in a first direction or in a second opposite direction to obtain a required core sample orientation position, or lights may be used to indicate when a required orientation position has been obtained.

The method may include deploying the orientation data gathering device leading a greaser. The greater device may preferably be a standard greaser.

Multiple time intervals may be measured by the device. These time intervals can be used to determine data gathering events, such as position, magnetic flux, gravity, velocity, acceleration etc. A time interval can be synchronised to a specific downhole data gathering event.

Data may be obtained from the orientation data gathering device by communication with a remote device, such as by an infra red link or other wireless communication, such as radio link, between the orientation data gathering device and an orientation data communication device.

A data gathering device according to one or more forms of the present invention does not continuously take 'core orientation' readings while in use. Instead, such a device determines when the device is 'motionless' (through its in-built firmware algorithms and sensors) before taking orientation readings. This arrangement of orientation recording confirms that the device only records valid data, i.e. while motionless, as the in-built sensors would otherwise present faulty or indeterminate readings.

If an operator erroneously selects a time interval for 'core orientation' (via the handheld unit while the data gathering device is still in motion), after retrieving the core sample, algorithms programmed into the device will determine the 'best-approximate' time interval relative to the device being 'steady' or 'motionless' at a time before or after a time selection by the operator using a hand held unit to communicate with the device as part of an embodiment of the system. The event and time difference will also be reported to the operator to confirm acceptance of that recorded data.

After core retrieval, the data gathering device provides an indication, using one or more light emitting diodes (LEDs), used to determine correct orientation of the core sample after rotating the device and core tube assembly in either direction (no indication of left or right direction is required). The LEDs do not necessarily indicate direction, but provides 'multi-level-speed' LED flashing rates, followed by a steady ON state LED illumination to determine correct core orientation. One or more other systems using various colours and flash rates, etc could be employed.

According to one or more embodiments of the present invention, before inserting the down-hole data gathering device into a drill hole, and after retrieving the same unit with the obtained core sample, the wireless handheld unit can start/stop or interrogate the down-hole device without having to remove or unscrew the unit from the drill-string or core tube sections. The handheld unit does not need to be attached, screwed in, mounted to or wedged to any part of the tubing or GCOU assembly during any operation).

Start/stop operations, setting the exact time for orientation, interrogating and recording 'confirmed-accurate' operator orientation procedure, may all be performed using a remote wireless hand-held unit communicating with the data gathering device unit that was down the drill hole.

Visual indication of core sample orientation may be provided through at least one aperture in a sidewall of a section of a downhole assembly. Core sample orientation indications may be as light through at least one aperture in the sidewall of a section of the downhole assembly, such as a greater unit. Core sample orientation visual indications may be provided from one or more light emitters via at least one light reflector, and preferably reflecting that emitted light out through the at least one aperture.

Whenever a core sample is drilled out from underground and placed on the surface, the core sample must be re-orientated to its original position that it was found.

One or more forms of the present invention aims to remove or reduce the human error aspect of this process present in known systems.

One or more forms of the present invention may include marking the core automatically and correctly, thus ensuring correct orientations of core samples and valid data is received by geologists.

According to one aspect the present invention provides a core orientation marking system to provide an identification mark on a core indicating a desired orientation of the core extracted from a below ground body of material, the system including a core orientation identification device and a marker device, the core orientation identification device including an alignment means and a mounting means to mount the device relative to an end of a tube exposing an end of the core to be marked, the mounting means permitting the device to rotate about the end of the tube, the alignment means arranged to provide an indication of correct alignment of the device relative to a known alignment of the core, and the marker device providing an identifiable mark on the end of the core corresponding to the known alignment of the core.

The core orientation identification device may be manually rotated about the tube end or rotated by force of gravity.

The core orientation may be marked on an end of the core manually or automatically.

The core orientation identification device may include at least one light arranged to indicate when the device is correctly orientated relative to the core to identify the required core orientation. The at least one light may be controlled to flash to indicate orientation is not yet correct. The at least one light may be controlled to flash slower the nearer to correct orientation is achieved by rotating the device about the tube and shows steady when correct orientation is identified.

Preferably, correct orientation is upright or substantially vertical relative to a corresponding upright or substantially vertical alignment of the orientation of the core.

The device may include two or more biased opposed members permitting width adjustment for mounting the device to respective tubes of a variety of diameters. The biased opposed members may include at least two opposed jaws. The biased opposed members may include rollers that are brought into contact with the tube when the device adjusts to the diameter of the tube and wherein the device is arranged to rotate by force of gravity about the tube.

The marker device may be incorporated as part of the core orientation identification device.

A system according to one or more forms of the present invention may include electronics and a power source for the electronics, the electronics including one or more accelerometers to detect correct orientation of the device and to send a signal or cease send a signal to indicate the correct orientation of the device relative to the known orientation of the core.

The marker device may be actuated automatically to mark the core by remote operation from a remote controller.

Position of the marker relative to the core end may be adjustable by an adjustment means. Position adjustment may be height, distance towards/away from or both, relative to the core end. The adjustment means may be mounted to the device.

The core orientation identification device may include a latch mechanism that is released upon receipt of a release signal to effect marking the core. The latch mechanism including a solenoid operated release.

The system may include a remote controller arranged to send a signal to the device to effect core marking, and the device includes electronics to detect whether the device is correctly orientated relative to the core, and to effect marking if orientation of the core and device correspond, and to prevent marking if the orientation of the core and device do not correspond.

Successful marking is logged in a memory of the remote controller or transmitted to another device.

Another aspect of the present invention provides a method of marking core orientation on a core sample, the method including using a device to automatically identify a correct orientation of the core, and marking that correct orientation on the core with a marker.

The method may include electronically actuating the marker to mark the core when the correct orientation is identified.

The method may include releasing a latch mechanism to release the marker to automatically mark the core. The latch mechanism may be released by receipt of a signal from a remote controller.

Correct orientation of the device relative to the core may be achieved by rotating the device under the force of gravity about a tube containing the core.

Successful correct marking of the core may be logged in an electronic device. The electronic device may include the core orientation identifying device and/or the remote controller.

DESCRIPTION OF PREFERRED EMBODIMENT

Figure 1:
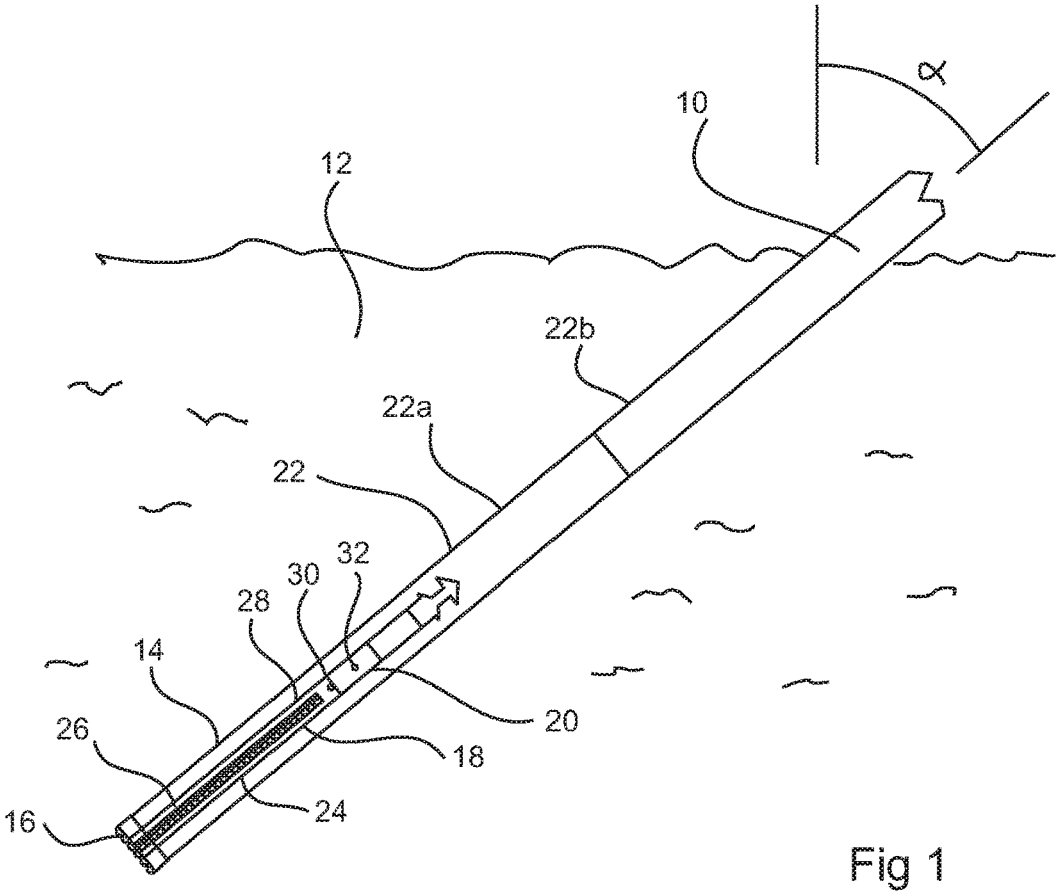
FIG. 1 shows a general arrangement of a drill assembly for obtaining core sample according to an embodiment of the present invention.

The present invention includes an embodiment with detection of a core for retrieval by separation or 'breaking' from the body of material from which it is drilled.

A drill assembly 10 for drilling into a subsurface body of material 12 includes a drillstring 14 including a drill bit 16 an out tube 22 formed of linearly connected tube sections 22*a*,22*b* . . . , and an inner tube assembly 18 including an inner tube 24 for receiving the core 26 drilled from the subsurface body.

One or more pressure sensors 28,30,32 can be provided to detect pressure, change in pressure and/or pressure differential. These can communicate with the core orientation data recording device and/or an operator at the surface. Once a required pressure value is detected, drilling can cease and the core orientation device can record data relating to the orientation of the core, such as gravitational field strength and direction, and/or magnetic field strength and direction.

Digital and/or electro-mechanical sensors, and/or one or more pressure sensors in a core orientation data recording device 20 are used to determine the core orientation just prior to the core break, and to detect the signal of the break of the core from the body of material.

Data recorded or used may optionally include 'dip' angle $\alpha$ to increase reliability of core orientation results.

Dip (also referred to as inclination or declination) is the angle of the inner core tube drill assembly with respect to the horizontal plane and can be the angle above or below the horizontal plane depending on drilling direction from above ground level or from underground drilling in any direction. This provides further confirmation that the progressive drilling of a hole follows a maximum progressive dip angle which may incrementally change as drilling progresses, but not to the extent which exceeds the 'dogleg severity'. The 'dogleg severity' is a normalized estimate (e.g. degrees/30 metre) of the overall curvature of an actual drill-hole path between two consecutive directional survey/orientation stations.

At the surface prior to obtaining the next orientation and core sample (or first if no previous core samples have been obtained for that drilling), a remote communication device (remote communicator) is set by an operator to a start time (say, T minutes).

The remote communicator communicates with the core orientation device and the core orientation device is then inserted into the drill hole.

After the set period of time (say, 'T' minutes) has elapsed the core orientation device will begin normal operation to detect the signature of vibration indicating a core break.

Alternatively, pressure changes or levels may be detected to indicate a pre-break condition or period, such as pressure of mud/water within the inner tube increasing due to the core filling or nearly filling the inner tube holding the core.

The core orientation device preferably does not take any orientation measurements while vibrations (e.g. due to drilling) are present. A combination of mechanical, electromechanical and/or electronic sensors and software algorithms programmed into the core orientation device determine that the core orientation device is in motion while descending down the hole and during drilling and is therefore not yet needed to detect breaking of the core sample from the body of material.

When ascending to the surface for core retrieval after core breaking ascending, the core orientation device also preferably does not take any core orientation measurements.

If any measurements are taken during descending or ascending, due to sensitivity limitations of the sensors or during erratic silence segments, such measurements are discarded as they don't match the correct signature.

When the drilling ends and the driller is ready to break the core, the driller instructions will be to observe a period of Y seconds silence (no rotation), (this may typically be greater than 10 s but no longer than 90 seconds). An Orientation & dip measurement will be taken during this period of silence. After breaking the core (breaking core operation should take less than, say 'X' seconds, which is typically X=20 s). Then the driller must wait, say 'Z' seconds silence (no rotation), (Z typically is greater than 90 s). The purpose of these timings is to produce the correct 'signature'. If one of these criteria is not met then the sample can be discarded.

Alternatively or in addition, pressure created within the borehole by 'mud and/or water (which may be pumped down the borehole from the surface) may be detected. One or more forms of the present invention may include detecting that pressure reaching a certain pressure. One or more pressure sensors may be provided on the drillstring, such as on the inner and/or outer drill tube or on the drill bit or on the core orientation data recording device. Detected pressure (such as pressure within the inner tube receiving the core) or pressure differential (such as pressure differential between/across the inner and outer tubes, may be indicative of the inner tube being nearly or totally full of core. This occurs before the core is separated from the subsurface body of material (such as by breaking the core from the body by a sharp pull back on the core) and hence provides a 'signature' or indicator that the core is about to be broken.

Figure 2:
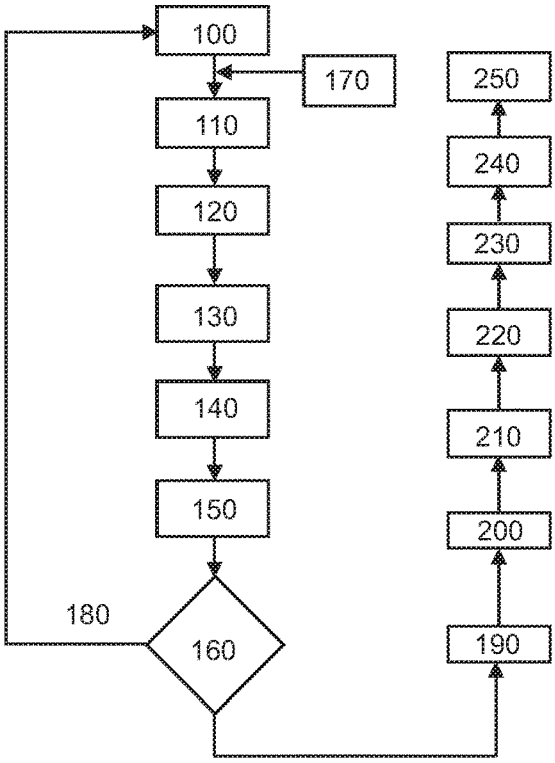
FIG. 2 shows an example of a flowchart relating to a method according to an embodiment of the present invention.

For at least one preferred embodiment as shown in the flowchart in FIG. 2, core orientation to be validated by the correct 'signature' can best be described when:

a) 100: Vibration above a threshold is not detected by the core orientation device, or is detected to be below a threshold, for period Y b) 120: Core orientation measurement is taken during the 'vibration silence' period Y c) 130: Followed by detection of noise from breaking the core from the subsurface body during a period X d) 140: Followed by no detection of noise above a threshold, or is detected to be below a threshold, for period Z e) 150: Orientation measurement is only retained if the above are present.

f) 160: The core orientation device can be configured to disregard detected signals or to not detect vibration or lack of vibration if & only if a, c, d above are present. If so, a fresh vibration silence signal 180 must then be detected before the core is broken.

g) 170: Optionally, dip measurement can be obtained during the period of no drilling prior to breaking the core (period Y), preferably if dip is within the set limits.

Once the required core orientation is obtained, the core orientation device may be shutdown or turned to low power standby mode 190 in preparation to be put into orientate mode 210 again.

Once the core orientation device is retrieved to the surface 200, an operator can set the device to an orientate mode 210. This can be done via the remote communication device communicating with the core orientation device 220.

The core orientation device can include one or more lights or other visual indicators, such as one or more display panels to give an indication of orientation direction and required orientation for marking the core.

According to one or more embodiments of the present invention, once in orientate mode, visual indications, such as flashing of one or more LEDs, will indicate to the operator which direction to rotate the core to find the correct 'down side' for marking. The correct downside is the part of the core that was lowermost prior to separating from the subsurface body.

Once correct downside is identified 230, the operator will again effect communication to the core orientation device via the remote communication device. The remote communication device will then verify 240 that the correct orientation was achieved (based on the orientation data recorded) and then preferably permit the operator to perform another orientation operation if so desired 250.

Optionally dip angle can be included in determining orientation of the core. The dip angle of the drill hole may be used to determine whether or not to use the orientation data obtained. For example, a correct core orientation sample may be determined from the aforementioned 'signature' steps being acceptable and the dip angle of the drill hole must also be within acceptable limits.

According to at least one particular embodiment of the present invention, the dip is sampled as a reference prior to the first run of a new drill hole. This is regarded as a setup function.

A setup function can be selected on the remote communications device which then communicates to the core orientation device. For clarity, the core orientation device does not orientate the core, rather, it records signals indicative of the orientation of the core to be retrieved. The core orientation device is then lowered down the hole or aligned to the angle of the drill rods in the case of no hole yet to be drilled.

Once the core orientation device is down to the end of the hole the user will 'mark' the 'shot', preferably via use of the remote communications device.

The core orientation device is then retrieved and the remote communications device communicates to the core orientation device so that the core orientation device knows the dip (angle) of the drill hole.

Alternatively, the dip of the end of the hole can be manually entered into the remote communications device and this communicated back to the core orientation device.

For subsequent recordal(s) of orientation data after the first i.e. whenever a required subsequent signature occurs, and when the dip value is used, the dip is measured and if second dip value (D2) equals dip value 1 (D1)+/−E (where E typically equals 1.1), the original signature data is retained. If D2 falls outside of D1+/−E, D2 is disregarded or discarded. The core orientation device will only store in memory values relating to the first signature.

For any subsequent run e.g. when the third signature occurs, if D3=D2+/−E the new signature is retained, otherwise it will be discarded if it falls outside of the required range. Only first compliant signature will be retained, etc.

One or more embodiments of the present invention may utilise the final compliant signature instead of the first compliant signature. A compliant signature is obtained when one or more signals indicative of the orientation of the core is/are obtained by the core orientation device during a period of no drilling vibration prior to detecting vibration from breaking the core and that being prior to a subsequent period of no drilling vibration.

Figure 3:
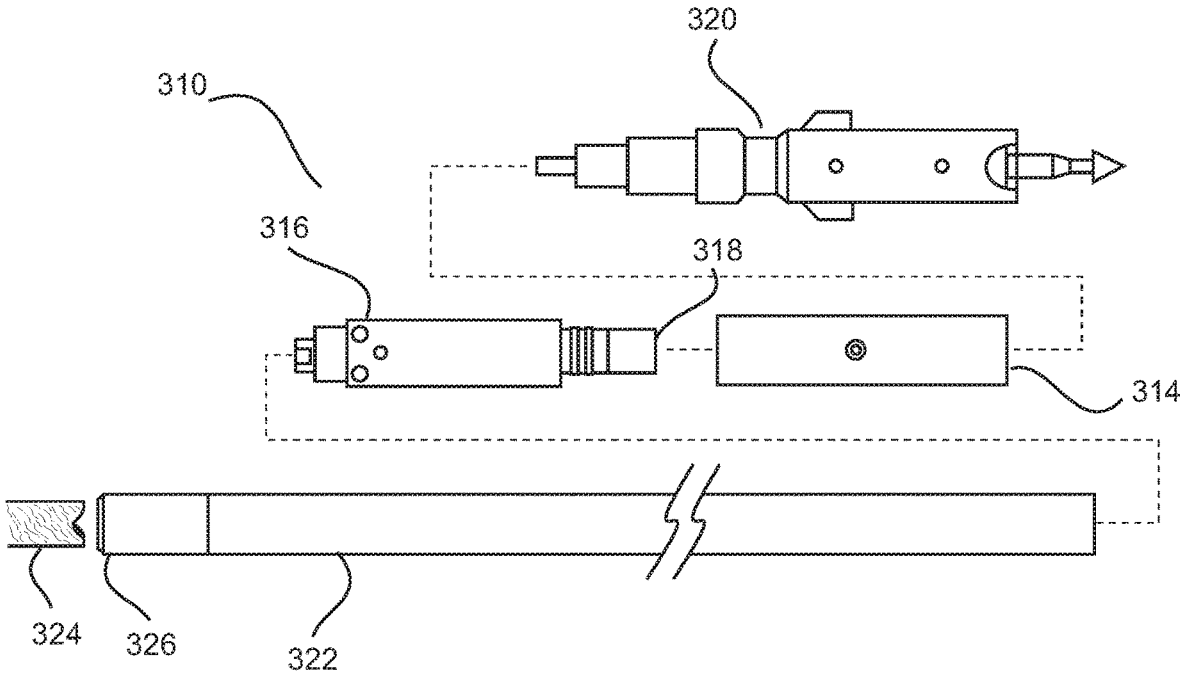
FIGS. 3 and 4 show features of a known core sample orientation system.
Figure 4:
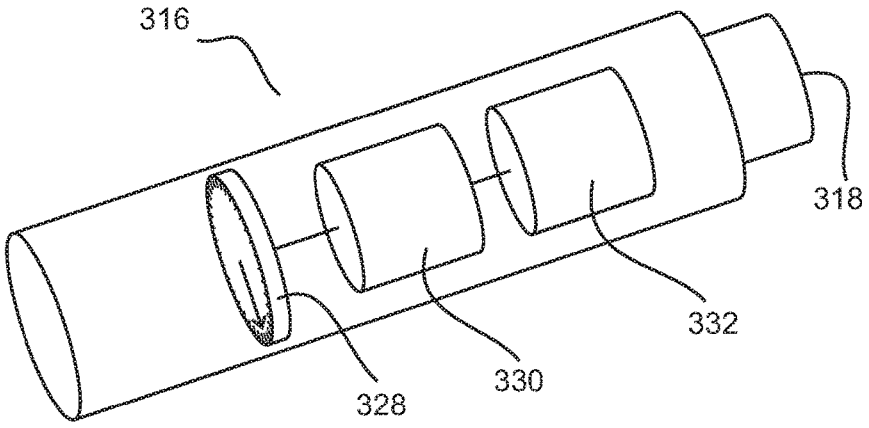
Figure 5A:
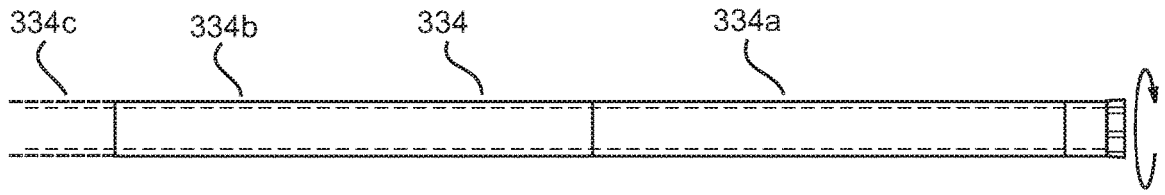
FIGS. 5A, 5B and 6 show features of an arrangement of a core sample orientation system according to an embodiment of the present invention.
Figure 5B:
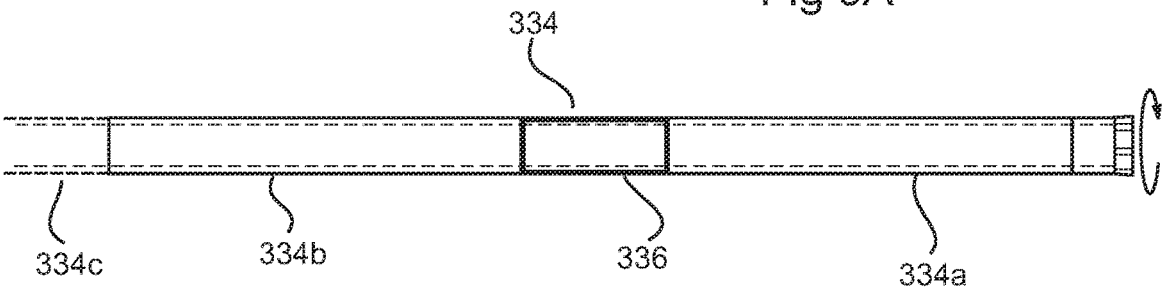
Figure 6:
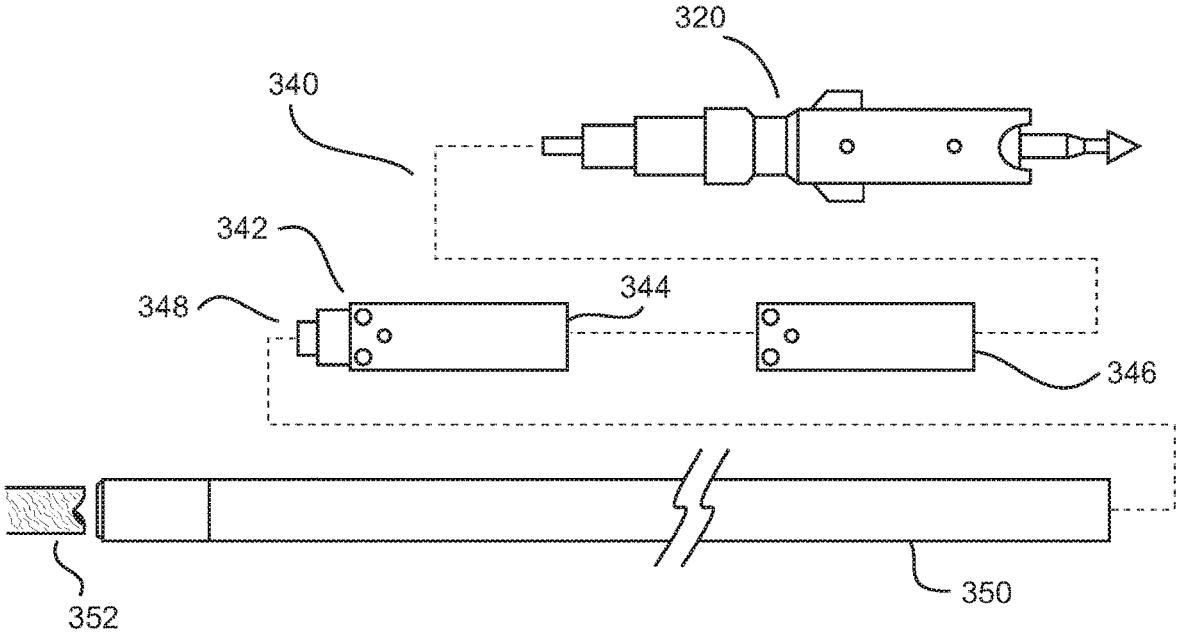

In FIGS. 3 and 4, a known prior art inner tube assembly 310 replaces a standard greater with a two unit system 314,316 utilising a specialised greater unit 314 and electronics unit 316 particular to the two unit system. The electronics unit is sealed to the greater unit by o-rings, which have a tendency to fail in use and allow liquid into the electronics unit, risking loss of data and/or display failure. The electronics unit has an LCD display 318 at one end. This allows for setting up of the system prior to deployment and to indicate visually alignment of the core sample when retrieved to the surface. The greater unit is connected to a backend assembly 320 and the electronics unit 316 is connected to a sample tube 322 for receiving a core sample 324. The electronics unit is arranged to record orientation data every few seconds during core sampling. The start time is synchronised with actual time using a common stop watch. The units are then lowered into the drill string outer casing to commence core sampling. After drilling and capturing a core sample in the inner core sample tube, the operator stops the stop watch and retrieves the core sample tube back to the surface. At the surface, before removing the core sample from the inner tube, the operator views the LCD display 318, if it is still working, which steps the operator through instructions to rotate the core tube 322 until the core sample 324 lower section is at the core tube lower end 326. The core sample is then marked and stored for future analysis.

Referring to FIG. 4, the known electronics unit 316 of FIG. 3 includes accelerometers 328, a memory 330, a timer 332 and the aforementioned display 318.

The system 340 according to an embodiment of the present invention will hereinafter be described with reference to FIGS. 5A to 8.

An outer drilling tube 334 consisting of connectable hollow steel tubes 334*a-n* has an extension piece 336 connected inline between two adjacent tubes in order to compensate the length of the outer drilling tube in relation to the additional length gained by the inner tube assembly 340 due to the core sample orientation data gathering device 342.

The core sample orientation data gathering device 342 is a fully sealed cylindrical unit with screw threads at either end. A first end 344 connects to a standard length and size greater unit 346 and a second end 348 connects to a core sample tube 350. The greater unit connects to a standard backend assembly 320.

Figure 9:
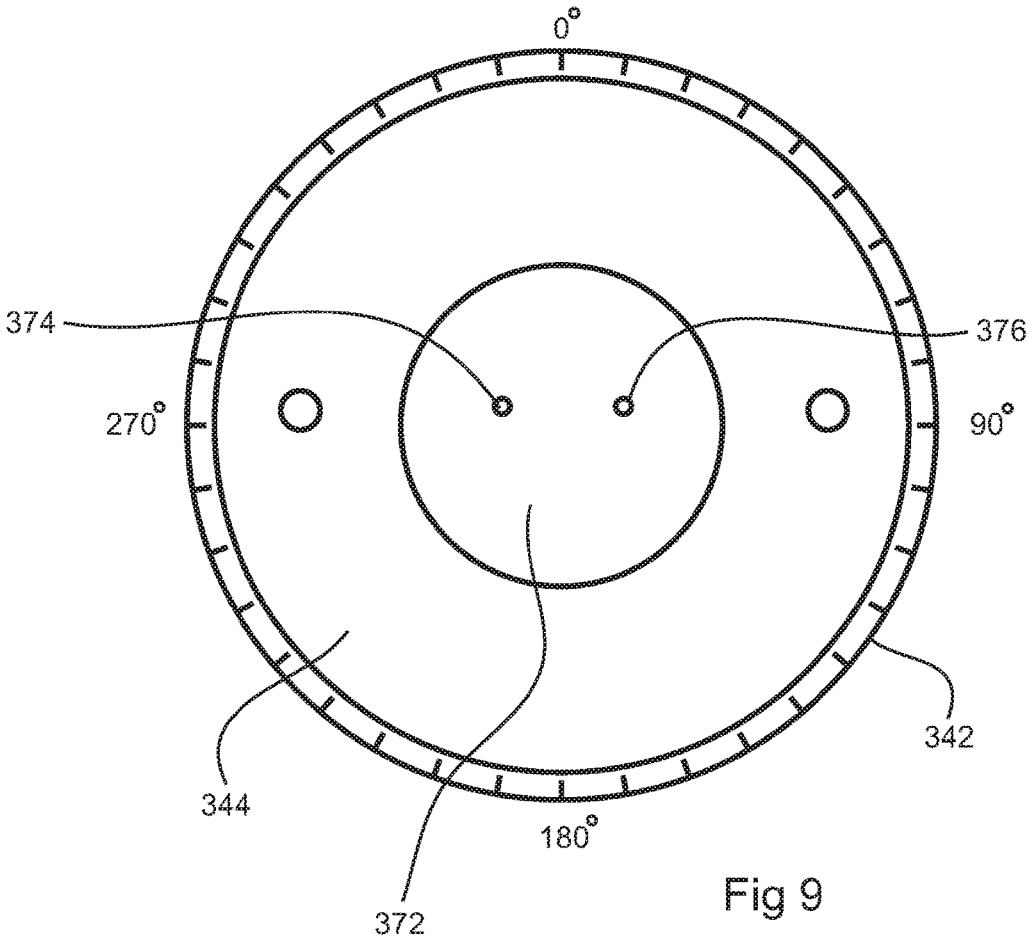
FIG. 9 shows an indicator window end of a core sample orientation device according to an embodiment of the present invention wherethrough indicator lights can show when illuminated.

There are no LCD display panels, indicators or switches mounted on the device. LED indicators are provided at one end 344, the greater end, that are used in determining correct orientation of the core sample once the core and the device are recovered back a the surface. FIG. 9 shows an example of the indicator end 344 of the core sample orientation data gathering device 342.

Figure 7:
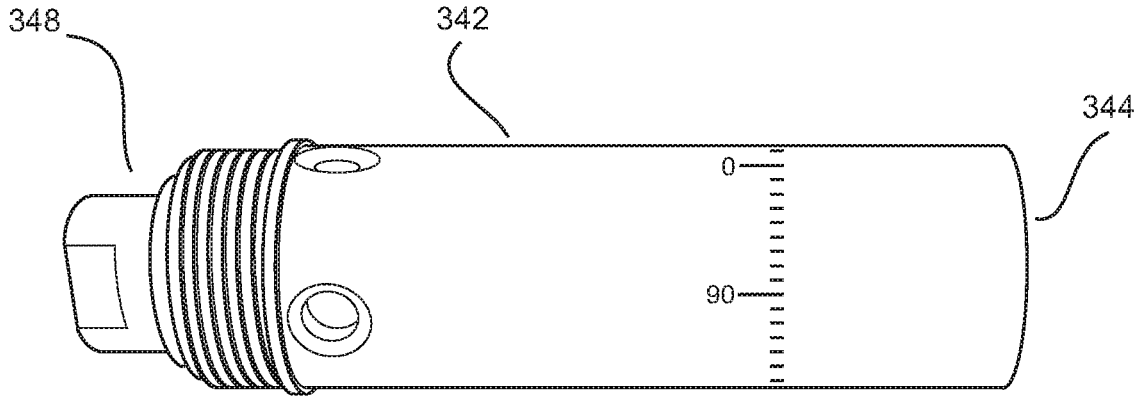
FIG. 7 shows a core sample orientation data gathering device according to an embodiment of the present invention.

In FIG. 7, the core sample orientation data gathering device 342 is shown in close up. The end 344 for connecting to the greater unit 346 includes a window (not shown in FIG. 7—see FIG. 9). One or more LED lights are provided sealed within the device 342 behind the window. A coloured light indication is given to indicate which way (clockwise or anti-clockwise) the device 342 must be rotated to obtain a desired orientation of the core sample still within the inner tube assembly that is connected to the core sample orientation data gathering device 342. For example, a red light may be given to indicate to rotate the device (and thus the core sample) anticlockwise or to the left, and a green light may be given to indicate to rotate the device clockwise or to the right. A combined red and green indication, or a white light indication, or other indication can be given, such as flashing lights, to indicate that the core sample is correctly orientated and ready for marking.

Figure 8:
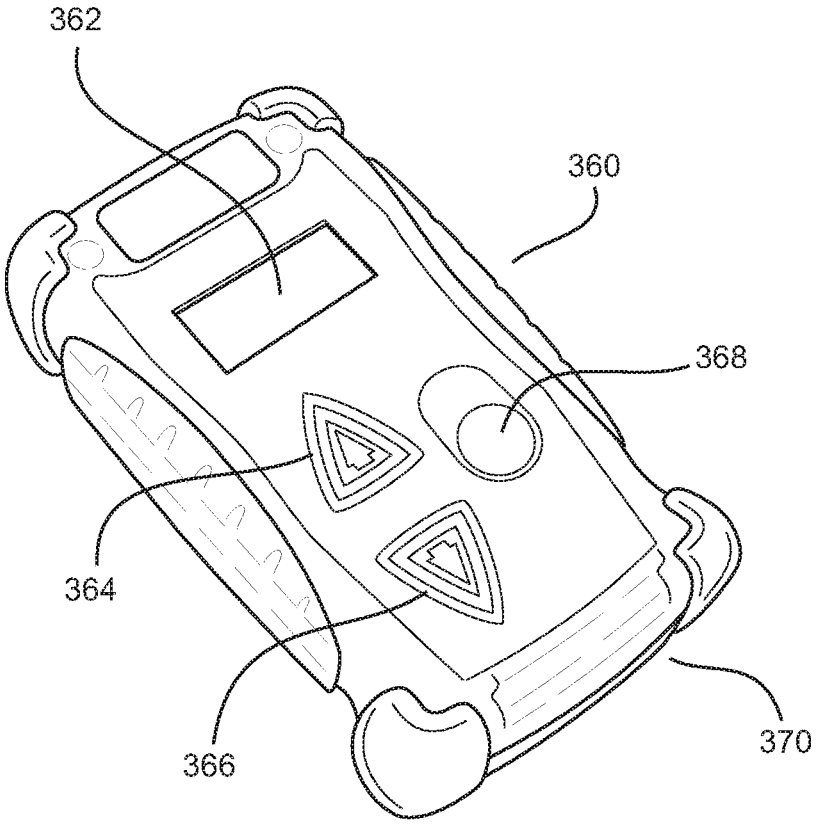
FIG. 8 shows a hand held device for interrogating the core sample orientation data gathering device according to an embodiment of the present invention.

FIG. 8 shows an embodiment of the hand held device 360 which receives wirelessly receives data or signals from the core sample orientation data gathering device 342. The core sample orientation data gathering device 342 includes a transmitter which can use line of sight data transfer through the window, such as by infra red data transfer, or a wireless radio transmission. The communication device 360 can store the signals or data received from the core sample orientation data gathering device 342. The communication device 360 includes a display 362 and navigation buttons 364,366, and a data accept/confirmation button 368. Also, the hand held device is protected from impact or heavy use by a shock and water resistant coating or casing 370 incorporating protective corners of a rubberised material.

Setting up of the device is carried out before insertion into the drill hole. Data retrieval is carried out by infra red communication between the core sample orientation data gathering device 342 and a core orientation data receiver (see FIG. 6) or communication device 360. After recovering the core sample inner tube back at the surface, and before removing the core sample from the tube, the operator removes the 'back end assembly, and the attached greater unit. The operator then uses the remote communication device to obtain orientation data from the core sample orientation data gathering device using an line of sight wireless infra red communication between the remote device and the core sample orientation data gathering device. However, it will be appreciated that communication of data between the core sample orientation data gathering device 342 and the communication device 360 may be by other wireless means, such as by radio transmission.

The whole inner tube 350, core sample 352 and core sample orientation data gathering device 342 are rotated as necessary to determine a required orientation of the core sample. The indicators on the greater end of the core sample orientation data gathering device 342 indicate to the operator which direction, clockwise or anti-clockwise, to rotate the core sample. One colour of indicator is used to indicate clockwise rotation and another colour to indicate anti-clockwise rotation is required. This is carried out until the core sample is orientated with its lower section at the lower end of the tube. The core sample is then marked for correct orientation and then used for analysis.

As shown in FIG. 9, the indicator window end 344 of the core sample orientation data gathering device 342 includes a window 372. The indicator lights can be seen through this window at least when illuminated. In this embodiment, two lights, red and green LEDs are shown. The left hand 374 (red) LED illuminates to indicate to a user to rotate the device 342 anti-clockwise. The right hand 76 (green) LED illuminates to indicate to a user to rotate the device 342 anti-clockwise. When correct core sample orientation is achieved, both LEDs might illuminate, such as steady or flashing red and green, or another illuminated indication might be given, such as a white light (steady or flashing).

The visual and/or audible indicators, under certain site and/or environmental conditions, may not be sufficiently visible or audible. They may be hard to see in bright light conditions or hard to hear in loud working environments. Thus, an additional or alternative means and/or method may be utilised to ensure that the core sample has been correctly orientated. The outer casing or body or an end of the core sample data gathering device 342 may have angular degree marks. These may be scribed, etched, machined, moulded or otherwise provided, such as by printing or painting, on the device 342. For example, as shown in FIG. 9 dashes equally spaced around the outside parameter (each representing one or more angular degrees of the full circle or perimeter). Further scribing of a number every five dashes starting with the number "0" then 5, 10, 15 etc. until 355. When the core is retrieved and the orientation device communicates with the hand held communicator 360, additional information is transmitted from the orientation device to the communicator 360, such as a number between Zero and 359 (inclusive) denoting an angular degree of rotation of the core sample orientation data gathering device and the core sample. When the core is oriented during one or more embodiments of the method of the present invention, scribing on the core sample orientation data gathering device 342 number on the top side should be the same as the number transmitted to the communicator 360, which re-confirms correct orientation. Thus, if the visual or audible means for indicating core orientation are not useful or available, then the core is oriented using the angular degree arrangement (top side) to match the number transmitted, and then this would be audited using the communicator 360 as is the case now.

The core sample orientation data gathering device of the present invention is hermetically sealed against ingress of water or other liquids, even at operative borehole depths and conditions. No additional or alternative sealing, such as separate o-ring seals between the greater and core sample orientation data gathering device or between the inner core tube and the core sample orientation data gathering device are required. Thus, maintenance or risk of ingress of liquid are not of concern.

Additionally, only the greater needs to be separated from the core sample orientation data gathering device in order to obtain access and communicate with the device to obtain core orientation data. Likewise, setup prior to deployment is improved in terms of time and ease of use by not requiring a specialised back end assembly, rather, a standard greater and back end assembly is used. This also improves compatibility with standard systems.

Obtaining core orientation is made easier by only requiring two colours lights to indicate one or other direction of rotation to establish correct core orientation prior to marking. The indicators form part of the sealed device and can be low power consumption LED lights. Alternatively, flashing lights may be used. For example, a certain frequency or number of flashes for one direction and another frequency or number of flashes for the other direction of rotation. A steady light could be given when correct orientation is achieved.

Confirmed correct core alignment is registered in the remote communication device 360. This provides for an audit trail, and the data can be readily transferred to computer for analysis and manipulation. This also provides reassurance of accuracy of sampling and orientation to operators, geologists and exploration/mining/construction companies.

In use, the core inner tube 350, data gathering device 342 and greater 46 are connected together in that order and lowered into a core sampling outer tube having an annular diamond drill bit at the furthest end. Once a core sample is obtained, the inner tube assembly with the data gathering device and greater are recovered back to the surface, the back end assembly 320 and greater are removed. Using an infra red link or other wireless link, the data gathering device is put into orientation indicating mode by the remote communication device 360. The core sample and data gathering device are then rotated either clockwise or anti clockwise to establish a required orientation position. The remote communication device is then used to communicate with the data gathering device to obtain core sample orientation data from the data gathering device. No LCD or other display is needed on the data gathering device that might otherwise risk leakage in use and ingress of liquid or failure of the display due to display power demands on the limited battery life or display failure due to the harsh environment downhole. The required orientation of the core sample is then marked and the core sample can be stored and used for future analysis. The received data can be transferred to a computer for analysis.

Figure 10A:
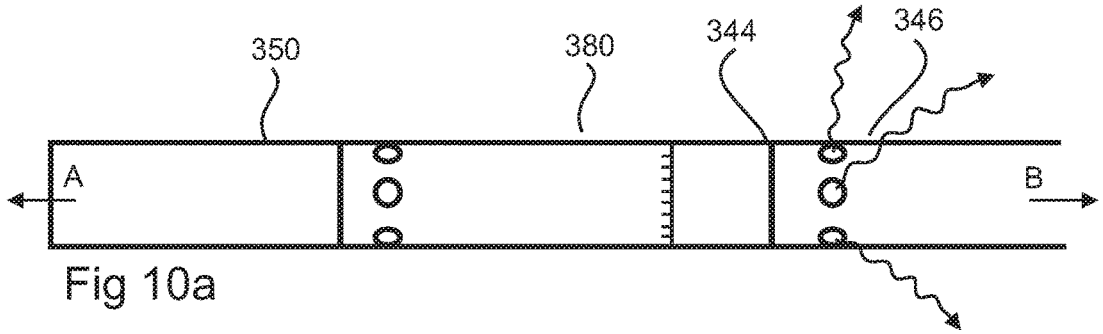
FIGS. 10*a* and 10*b* show an alternative embodiment of a data gathering device of the present invention.
Figure 10B:
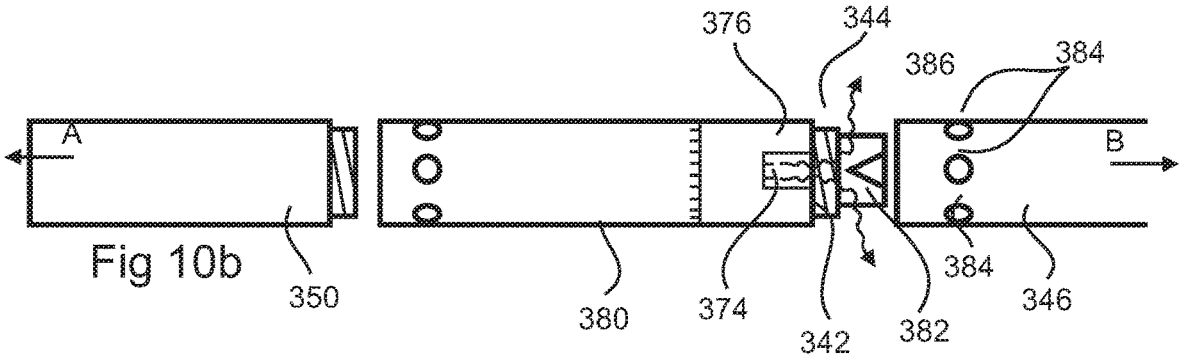

According to an alternative embodiment of the present invention shown in FIGS. 10*a* and 10*b*, a data gathering device 380 houses the light emitters 374,376. Light from these emitters (e.g. LEDs) passes through the window 372 (shown in FIG. 9). Reference arrow A refers to the drill bit end direction, and reference arrow B refers to the backend assembly direction. An optical adapter 382 is provided at the end 342 of the device and which adapter extends into the greater unit 346 when connected thereto. The optical adapter has a reflective material. The greater unit 346 has apertures 384 that allow light therethrough. Light from the emitters is directed onto at least one reflector 386 of the adapter. The emitted and reflected light can be observed through the apertures 384 in the greaser. It will be appreciated that the adapter need not extend into a greaser. A tube section or other component having at least one aperture to observe the light through is sufficient. The red-green indications (or whatever selected colour combination of light is used) can be observed through the aperture(s) when rotating the device to obtain core sample orientation. Thus, advantageously, when the data gathering device and core sample are recovered from down the hole, the data gathering device need not be separated from the greater in order to determine a required orientation of the core sample. Wireless communication to a remote device, such as a hand held device, to transfer data between the data gathering device and the remote device, can also be effected by transmitting through the at least one aperture.

Embodiments of the present invention provide the advantage of a fully operating downhole tool/device without having to disconnect or disassemble any part of the tool/device from the inner tube and/or from the backend assembly or any other part of the drilling assembly that the tool/device would need to be assembled within for its normal operation. Disconnecting or disassembling the tool/device from the backend and/or inner tube risks failure of seals at those connections and/or risks cross threading of the joining thread. Also, because those sections are threaded together with high force, it takes substantial manual force and large equipment to separate the sections. High surrounding pressure in the drill hole means that the connecting seals between sections must function perfectly otherwise water and dirt may ingress into and damage the device. Having a tool/device that does not need to be separated from the inner tube and/or backend sections in order to determine core sample orientation and/or to gather data recorded by the device/tool means that there is less risk of equipment failure and drilling downtime, as well as reduced equipment handling time through not having to separate the sections in order to otherwise obtain core sample orientation. Known systems require end on interrogation of the device/tool. By providing a sealed device/tool and the facility to determine orientation of the core sample, by observing the orientation indications through one or more apertures in the side of the greater or other section, reliability and efficiency of core sample collection and orientating is improved. Consequently operational personnel risk injury, as well as additional downtime of the drilling operation. Without having to separate the tool/device from the inner tube and/or backend, the orientation of the core sample can be determined and the gathered information retrieved with less drilling delay and risk of equipment damage/failure.

One or more forms of the present invention relate to asynchronous time operation for core sampling. The data recording events taken by the downhole data gathering device are not synchronized in time with the communication device. That is, the communication device and the data gathering device do not commence timing from a reference time, and the data gathering device does not take samples (shots) a specific predetermined time intervals. For example the data gathering device does not take a three second sample every one minute with that one minute interval synchronized to the remote which would therefore know when each sample is about to take place. The communication device of the present invention is not synchronized to the data gathering device (the downhole survey or core orientation unit) i.e. asynchronous operation, and therefore the communication device does not know if or when a sample is being taken. Thus, obtaining an indication of core sample orientation is simplified over known arrangements.

Figure 11:
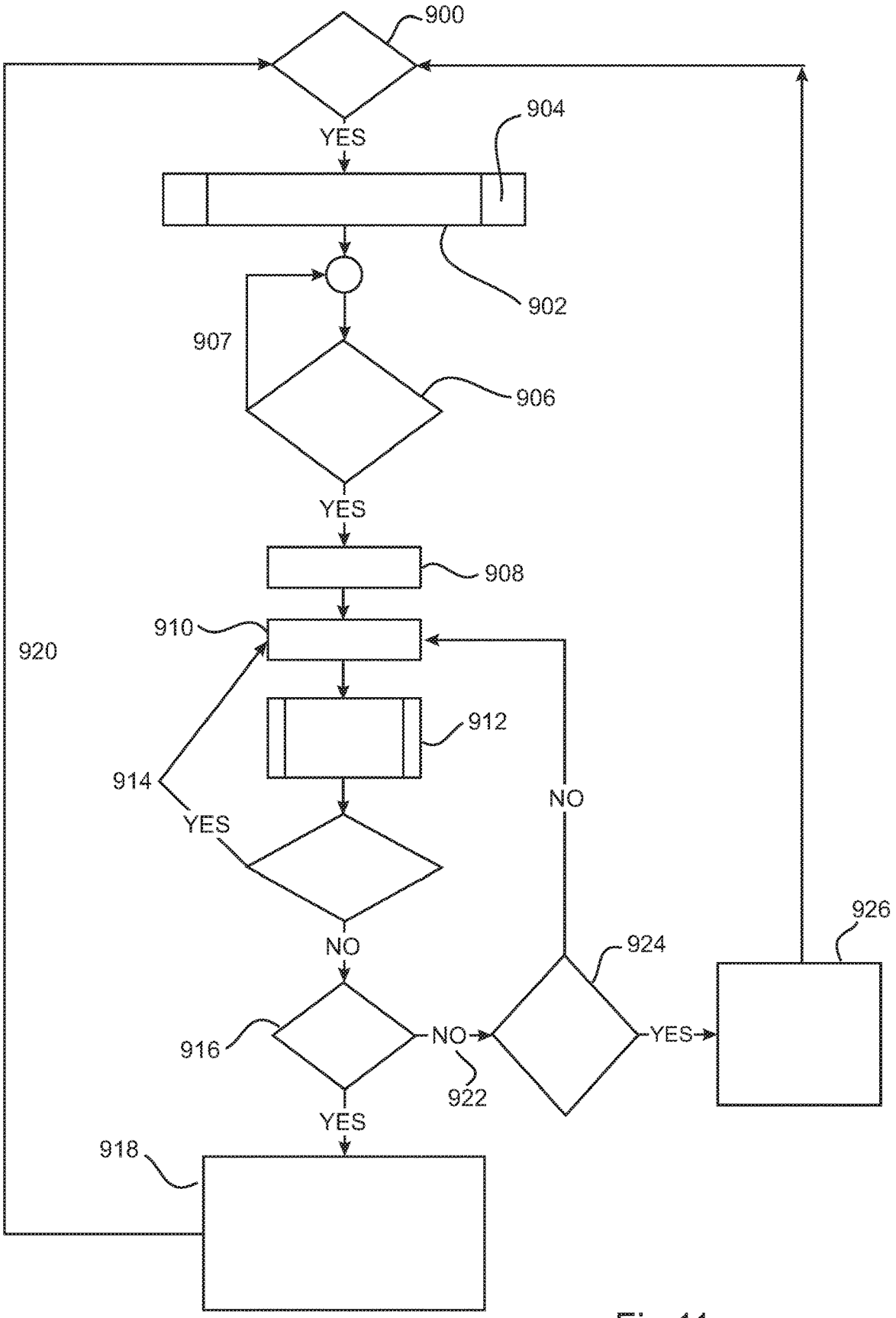
FIG. 11 is a flow chart showing steps involved in obtaining usable recorded data of downhole survey equipment for determining orientation of a core sample according to an embodiment of the present invention.
Figure 12:
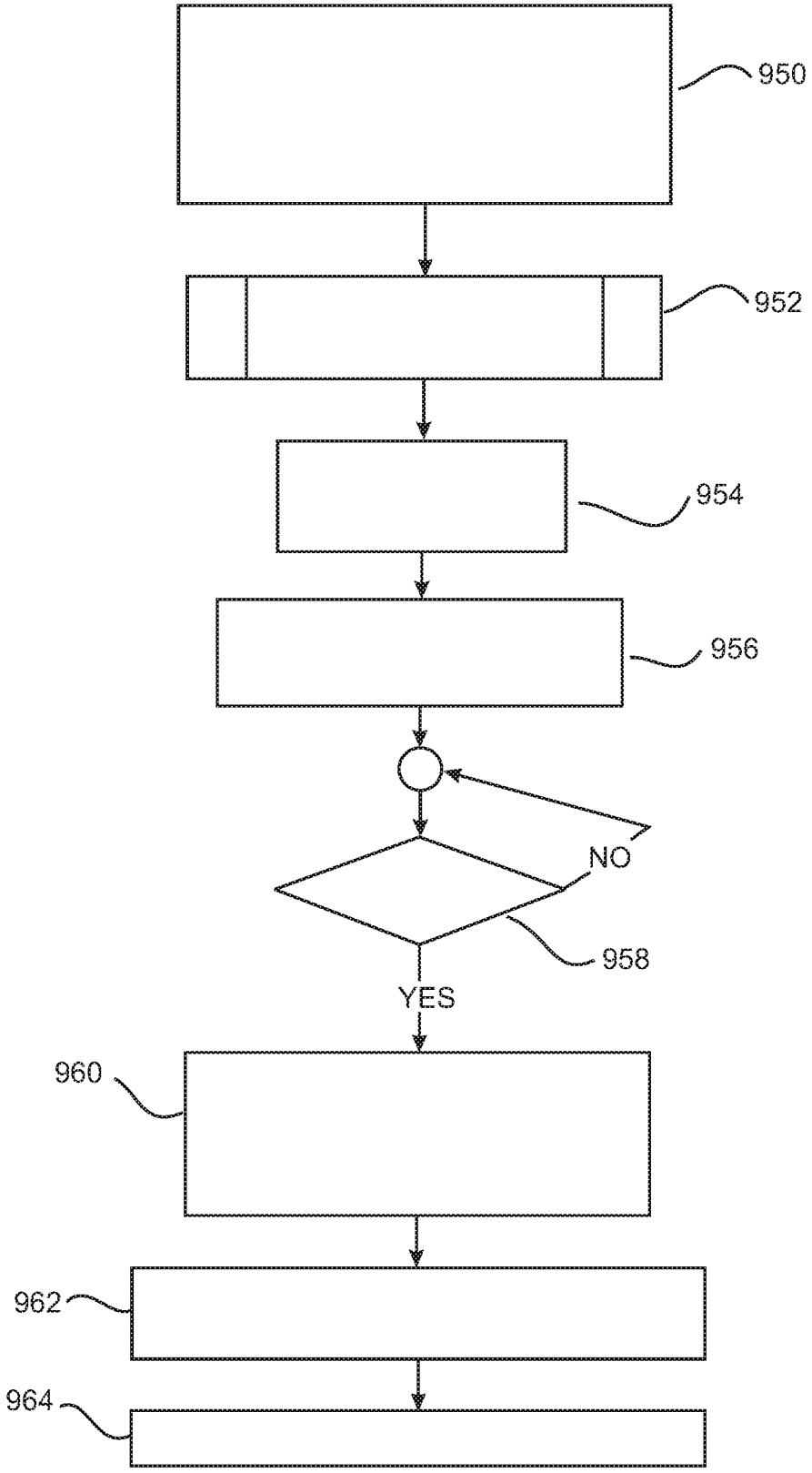
FIG. 12 is a flow chart of selection of useable data for use in determining core sample orientation according to an embodiment of the present invention.

A method and system according to one or more embodiments of the present invention will hereinafter be described with reference to the Figures, particularly FIGS. 11 and 12.

A communication device 360 can signal to the data gathering device 342,380 to activate or come out of a standby mode. However, if preferred, the data gathering device may already be activated i.e. it is not necessary to have the data gathering device switch on from a deactivated ('turned off') state.

The communication device 360 and the data gathering device 342,380 do not require to send or exchange time information from one to the other.

The communication device 360 does not mark start time and the actual start time is not recorded by or in the communication device 360.

The communication device 360 does not start a timer, its clock (preferably a 'real time' clock) is permanently running.

The data gathering device 342,380 does not record a start time as an initial reference time. Thus, it is not necessary to make a data gathering event (shot) in a specific period of time beyond this reference time. The data gathering device does not start a timer, its own internal clock is always running.

No initial roll indication at the surface prior to deploying the device is required. Thus, no initial reference point is required before the device is deployed downhole of the data gathering device 342,380 is taken before lowering downhole as a reference "orientation point".

Importantly, the data gathering device only records data (takes 'shots') when it detects drilling is not occurring. That is, the data gathering device does not obtain or generate downhole data during drilling.

For the purposes of this invention, the phrase 'during drilling' means whilst drilling (i.e. rotation of the drill bit and drill string) is actually occurring rather than the general drilling operation as a whole. Data recording events ('shots') are not constantly taken on a set time period.

The data gathering device 342,380 of the present invention includes at least one vibration sensor, and preferably at least one of a gravity sensor, magnetic field sensor, accelerometer, inclinometer, and preferably a combination two or more of these devices. These 'sensors' are packaged into the data gathering device which is compatible for connection with downhole tubing, greasers and other instrumentation devices. The data gathering device is powered by an onboard battery, and preferably the data gathering device is hermetically sealed to prevent ingress of water and contaminants at pressure when 'downhole'. The data gathering device forms part of a system in conjunction with the communication device 60, and preferably any other equipment as needed.

The communication device may be incorporated in a remote controller. For example, a remote controller may be used to control or affect operation of the data gathering device. The remote controller may include an internal timer which operates without synchronization with an internal timer of the data gathering device.

One form of the present invention provides the following method, whereby:

1. When the data gathering device 342,380 initially detects vibration 900 it wakes 902 from a standby mode. The device determines that such vibration is because drilling is occurring. While awake at this stage the device also checks 904 whether there is a valid communication from the communication device. The device then goes back into a standby mode until vibration is not detected above a threshold, which is preferably set to be zero detected vibration. This has a valuable benefit of saving battery power. Known prior art devices, such as in WO 2006/024111 and related cases, continuously draw or on a frequent periodic basis draw on battery power, thereby vastly decreasing battery life and reducing the amount of time a device can spend in operation before the battery needs recharging or replacing. Extending battery life is a major benefit to drilling operations which occur in remote locations. Less capital investment is needed in equipment to maintain a charged standby device, and less time is lost in changing over equipment if battery life is extended.
2. Once no vibration has been detected for a desired period (e.g. 6 seconds) 906, the data gathering device determines that drilling has stopped, the device activates ('wakes up' from its standby or 'sleep' mode) 908 and records first data ('takes a 1$^{st}$ roll shot') 910. The device will self check 907 whether there is no vibration for the desired period of time.
3. A desired period of time later (e.g. 4 seconds) 912, the data gathering device records second data ('takes a 2$^{nd}$ roll shot') 914. If the second data recording event (roll) is close to the immediately previous first data recording event (1$^{st}$ roll shot) 910 and found to be acceptable 916, then the second data recording event 914 is saved to a memory and time stamped 918.

The data gathering device then stops recording data and reverts to its standby or 'sleep' mode and either:

a) waits at step 5 below) 920, or b) continues to step 4) below 922.

4. If the second data recording event (2$^{nd}$ roll shot) is not similar 922 to the first data recording event, then a third data recording event is carried out ('3$^{rd}$ roll shot'). This 3$^{rd}$ shot's roll is compared to the 2$^{nd}$ shot's roll. If the third data recording event is close to the second data recording event, then the third data recording event is stored in memory and time stamped, and the data gathering device reverts to standby ('sleep') mode. Thus, the device compares the most recent data recording event to the immediately previous data recording event. This process continues until:
   a. one data recording event (roll) is accepted and time stamped 918; or
   b. a limit or preset maximum number of recording events is reached (e.g. five 'shots') 924 then the data gathering device will revert to standby or 'sleep' mode (shut down) and wait for the next vibration to occur 900.
5. When the next vibration 900 event is detected, the data gathering device comes out of standby mode ('wakes up') 904. This allows the data gathering device to determine that vibration is occurring and then it reverts to standby mode ('goes to sleep again') in preparation to be re-activated at the next 'No vibration' event 906. This occurs without the need to take or record any downhole data (rolls) in memory. If none of the roll shots are acceptable, the device is set to wake on the next vibration and then go to sleep again 926.
6. Steps 1) to 5) are repeated until the data gathering device receive a signal to enter an 'orientation process'. The signal is preferably provided by the communication device.

Remote controller (communication device)

A user inputs 950 to the communication device one or more of the following:

1. the last time when drilling has stopped
2. immediately prior to breaking off the core sample off;
3. immediately after breaking off the core sample.

The communication device identifies ('marks') a time 952, using its own real time clock, when a user selects that the core sample is to be retrieved.

Importantly, the present invention does not need or rely on an indication indicative of when during the drilling process the core sample was detached from the body of material.

Once the core sample has been broken off, and the time is marked by the communication device before, during or after that core breaking off event, the core assembly is retrieved to the surface.

Once the data gathering device is retrieved to the surface 954, the communication device communicates 956 to the device, and the device confirms communication received 958. The communication device signals to the data gathering device to halt surveying 960 and the communication device obtains from the data gathering device recoded data prior to a defined time elapsed period 960. At this point in time the communication device refers to its own internal clock and subtracts from this the time that the user indicated that the core was being retrieved 962. This time difference is transmitted to the data gathering device as a time value, which device enters a core orientation process stage 964.

Core Orientation Process

The data gathering device receives the time value (days, hours, minutes and seconds) (e.g. from the communication device) and enters an orientation process stage 964, as mentioned above.

The data gathering device deducts this time value from a predetermined time value in its own internal timer. The data gathering device checks for a saved data event 'roll' that occurred previous to this time in its memory, and retrieves that roll value. No time measurement is measured, and the data gathering device does not provide a time value indicative of when the core sample was broken off. Such a value is not required to determine orientation of the core sample.

The data gathering device then provides visual indications of which direction to rotate the core sample to indicate the 'downside' of the core. As discussed earlier in this specification, light indicators, such as the flashing coloured LEDs, and the described method of use, can be employed to indicate to the user which direction to rotate the barrel to the required 'downside'. For such use, a user rotates the barrel until the flashing stops and a solid ON LED indicates that the barrel is in the 'downside' position.

User inputs to the communication device to indicate that the core barrel, and therefore the core sample, is in the correct orientation. The communication device communicates to the data gathering device and verifies that this has occurred. This 'orientation' or 'roll' value is not transferred from the data gathering device to the communication device.

One or more further embodiments of the present invention will hereinafter be described with reference to the accompanying FIGS. 13 to 19.

The present invention involves a system 460 utilising a core sample (core) orientation identification device 410 and a marker device 490. These components may be provided separately as discrete items or may be connected together, such as by an adjustment means.

Typically the extracted inner core tube 412 is placed on a support 480 for ease of work. After the inner core tube 412 containing the core sample 414 has been orientated to the up/down position (corresponding to its orientation underground before being drilled out), the pen/pencil marker 416 associated with the device 410 is adjusted to a pre-set height corresponding to the diameter size of the core tube used. The device is then activated by pulling the opposed handles 420,422 apart to a 'latched' position of the device ready to be released when signaled to do so.

The unit is placed on the core tube by opening the jaws assembly 424 sufficiently wide to allow the opposed jaws to be placed about the external diameter of the tube 412. This embodiment includes three jaws 426,428,430. The first 426 and third 428 jaws oppose the second jaw 430 with the second jaw operating between the first and third jaws. It will be appreciated that two opposed jaws can be sufficient. One or both of the opposed jaws can have a bifurcated end with rollers thereon rather than the three jaws with rollers.

The device is positioned such that the marking pen/pencil faces the exposed core face 'A'.

By closing the opposed jaws together, the rollers 432 on the jaws contact the external surface of the core inner tube 412, which allows the device to find its correct position via gravity so that the marker is pointing to the lower portion of the core face A. The device hangs or suspends from the tube.

The device contains a self-feeding and extruding wax nib which will always be extended ready to mark the core face A. This can be position adjusted via the adjustment means 418.

Electronics within the housing 434 of the device include one or more central processors, accelerometer(s), infrared communication components, other supporting components and a battery power supply 442.

There is also an electromechanical releasing device 440 to allow the marking pencil to stamp the core face when required. This may be in the form of a solenoid which when activated, releases the compressed spring 444 previously latched when the handles 420,422 were pulled in opposite directions to set the latch 446 against a latch plate 448. As is shown, the handle 420 has sliders 450,452 which slide in bushes 454.

In preferred embodiments the electronics can operate to confirm the up/down position of the device using its accelerometer(s) and other components.

One or more light emitting diodes (LEDs) 456 can be provided behind a window 458 on the device. The window may be an IR window for communication between the device and the remote controller. The LED(s) can be set to illuminate or extinguish when not centered. In a preferred embodiment, the LED(s) flash when the device is not centred and are steady when it is centred (see infrared window 56 pointed to by the hand-held controller 460 in FIG. 18).

When self-alignment is completed by the device, the hand-held controller 60 signals the device via infrared communication to release the marking pen/pencil. The embedded electronics confirms that the unit is properly aligned before allowing activation to release the marking pen/pencil towards the exposed core face and thereby mark its lower end to indicate correct orientation.

Figure 17:
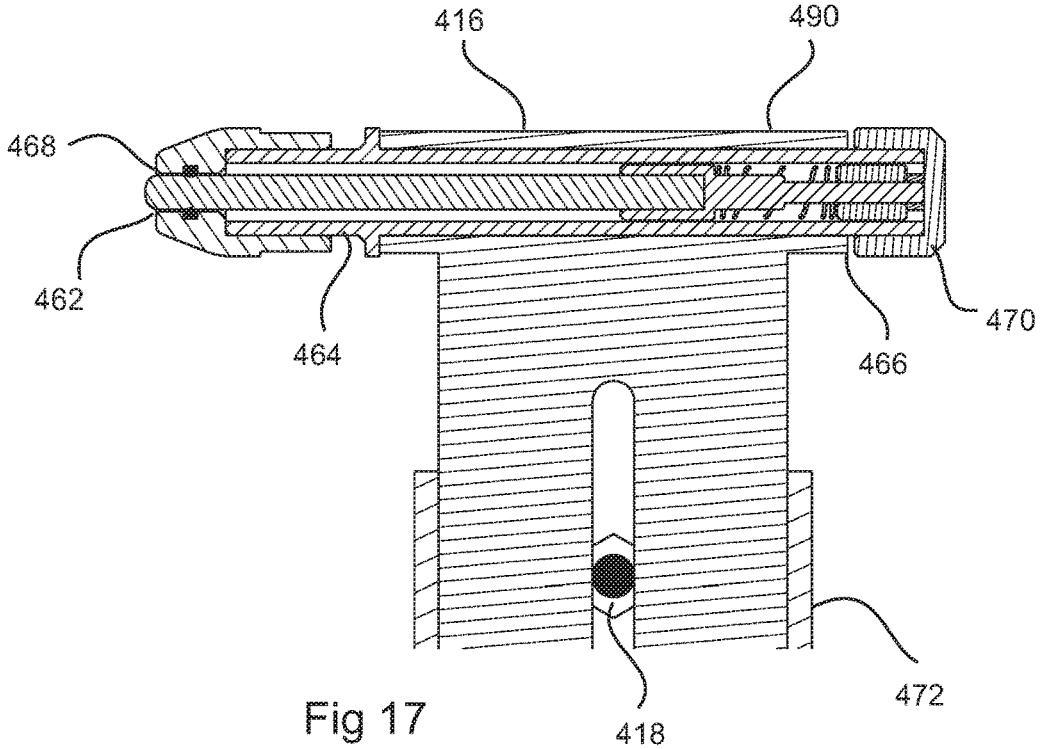
FIG. 17 shows a sectional view of a portion of the device with a marker within a spring loaded cartridge.
Figure 18:
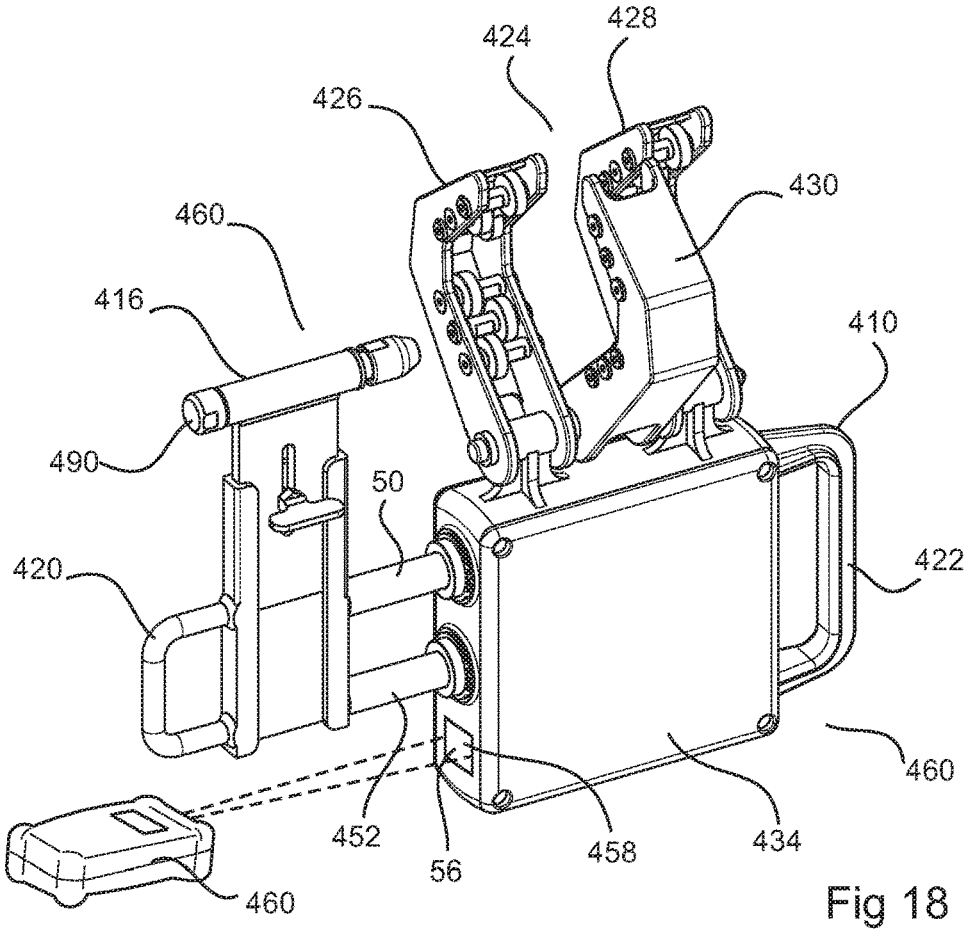
FIG. 18 shows a system according to an embodiment of the present invention including a remote device communicating with the device of FIGS. 1 to 5 and used to confirm correct lower side core orientation.
Figure 19:
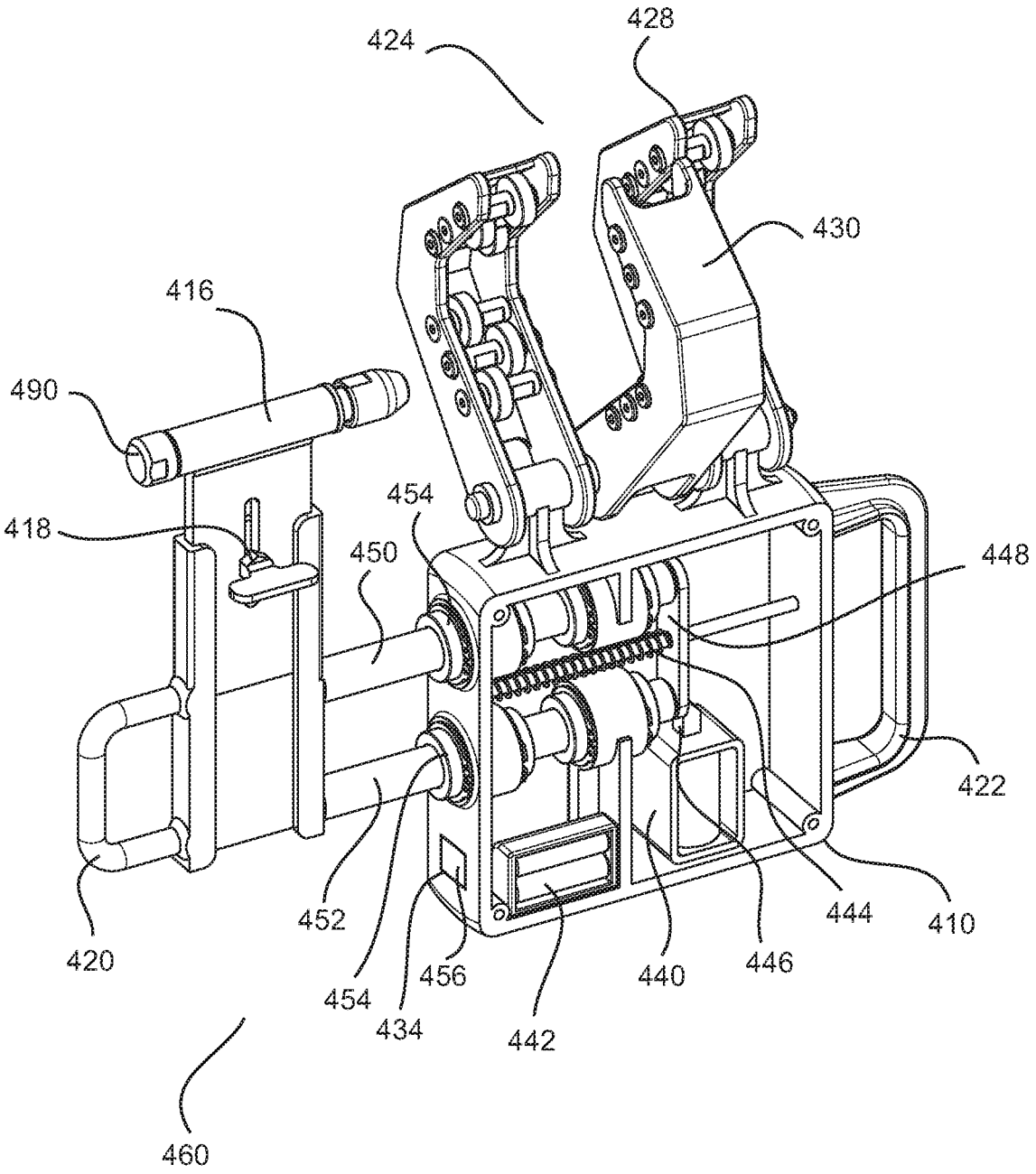
FIG. 19 shows a sectional view through a core marking device according to an embodiment of the present invention.

FIG. 17 shows a sectional view of the pencil holder 416. A wax pencil core 462 is held within the tubular body 464. The pencil core is spring 466 biased to protrude from the open end 468 of the holder. A removable screw cap 470 allows replacement of the pencil core.

Figure 13:
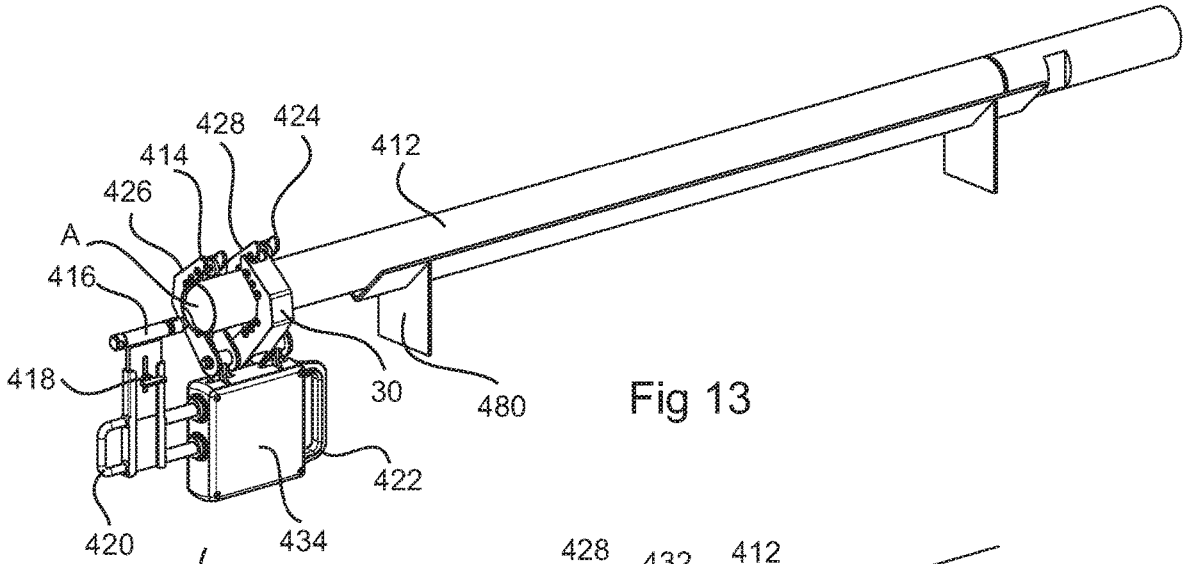
FIGS. 13 to 15 show the device in place ready for marking the lower face of the core after orientation, and which is still within the core tube.
Figure 14:
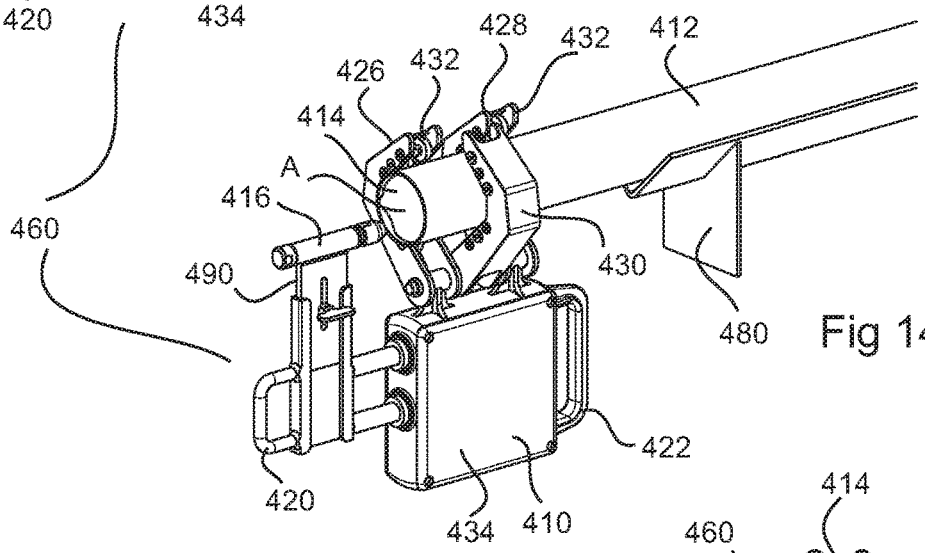
Figure 15:
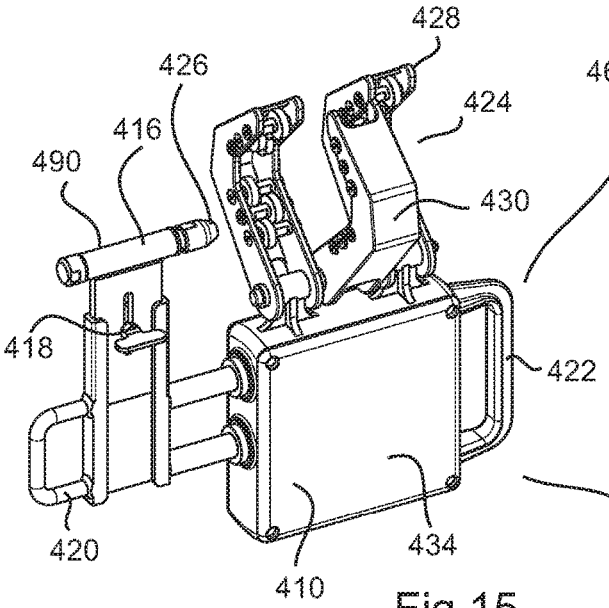
Figure 16:
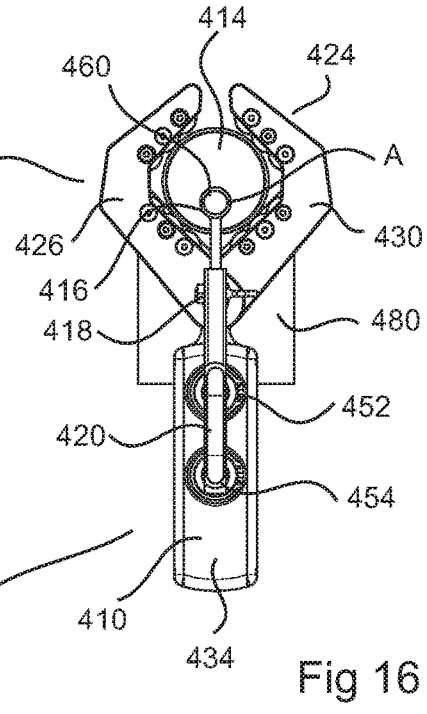
FIG. 16 shows a view of the device with wheels used to locate and orientate the device via gravity before marking the core end face.

Height adjustment for the marker is achieved by releasing the adjustment mechanism 418, raising or lowering the pencil holder 416 relative to the support 472 attached to handle 420 (seen in FIG. 13, not shown in FIG. 17).

Figure 20A:
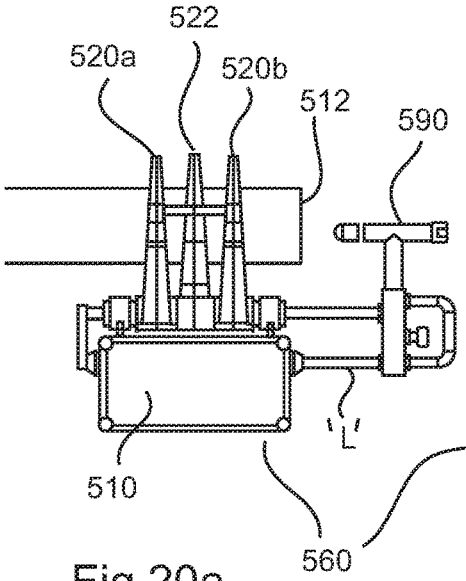
FIGS. 20*a* to 20*c* show respective side, perspective and end views of an alternative embodiment of a core marking device of the present invention.
Figure 20B:
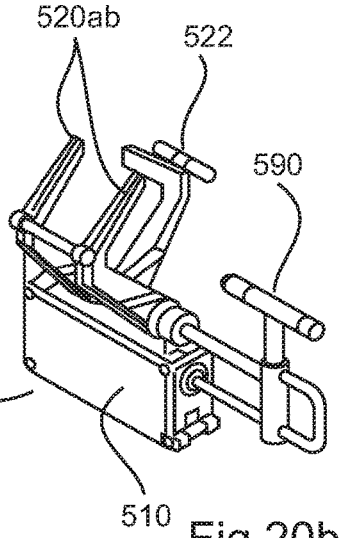
Figure 20C:
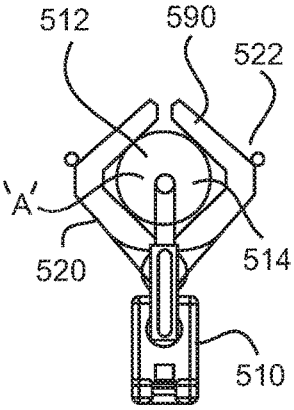

In FIGS. 20*a* to 20*c*, an embodiment of a self aligning system 560 (aligning with respect to the core 512), including core sample orientation device 510 and a marker device 590

Typically the extracted inner core tube 512 is placed on a support 580 for ease of work. After the inner core tube 512 containing the core sample 514 has been orientated to the up/down position (corresponding to its orientation underground before being drilled out), the pen/pencil marker 516 associated with the device 510 is adjusted to a pre-set height corresponding to the diameter size of the core tube used. The device is then activated by extending the pencil assembly to a 'latched' position "L" of the device ready to be released when signaled to do so.

The unit is placed on the core tube by opening the jaws assembly 520,522 sufficiently wide to allow the opposed jaws to be placed about the external diameter of the tube 512. This embodiment includes three jaws 520*a*,522,520*b*. The first 520*a* and third 520*b* jaws oppose the second jaw 522 with the second jaw operating between the first and third jaws. It will be appreciated that two opposed jaws can be sufficient. As a component saving measure and to provide a simplified device, no rollers are provided on the ends of the arms/jaws 520*a*,520*b*,522. Gravity causes the device to rotate to a stable orientated position ready for operation.

The device is positioned such that the marking pen/pencil faces the exposed core face 'A'.

Figure 21A:
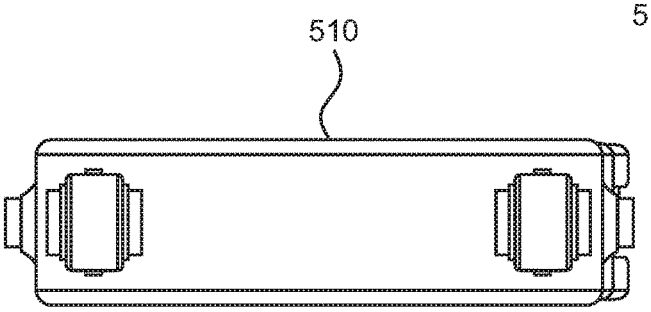
FIGS. 21*a* to 21*c* show respective top, perspective and side section views of part of the alternative embodiment of a core marking device of the present invention shown in FIGS. 20-20*c*.
Figure 21B:
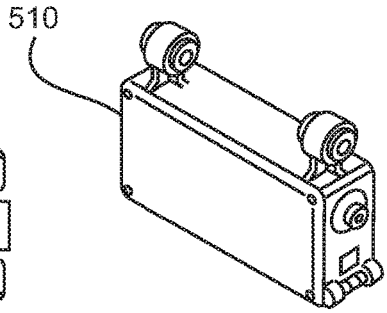
Figure 21C:
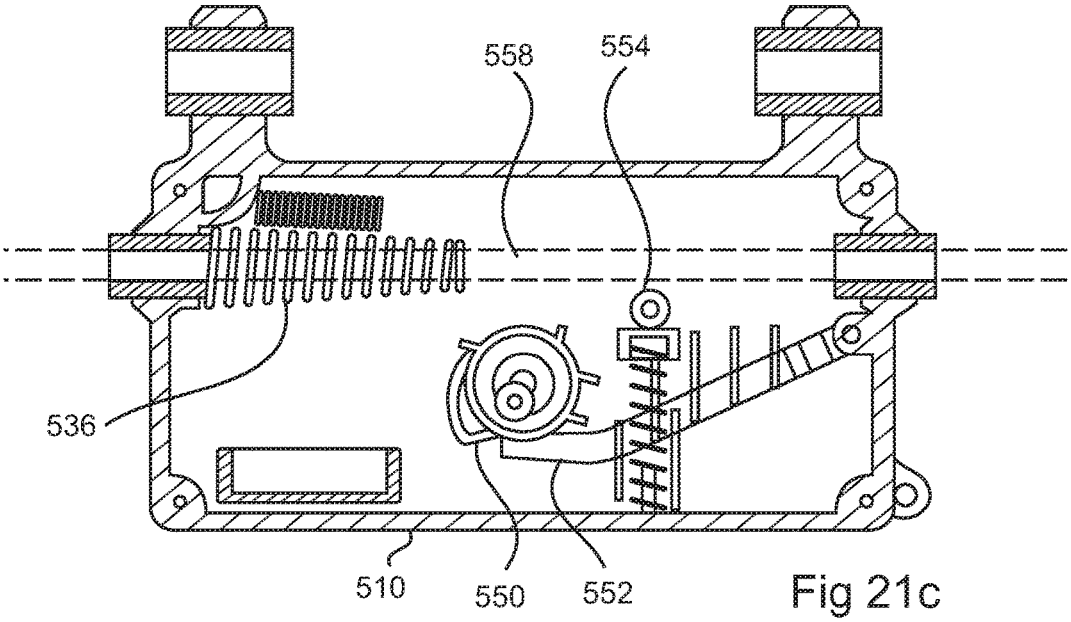
Figure 22A:
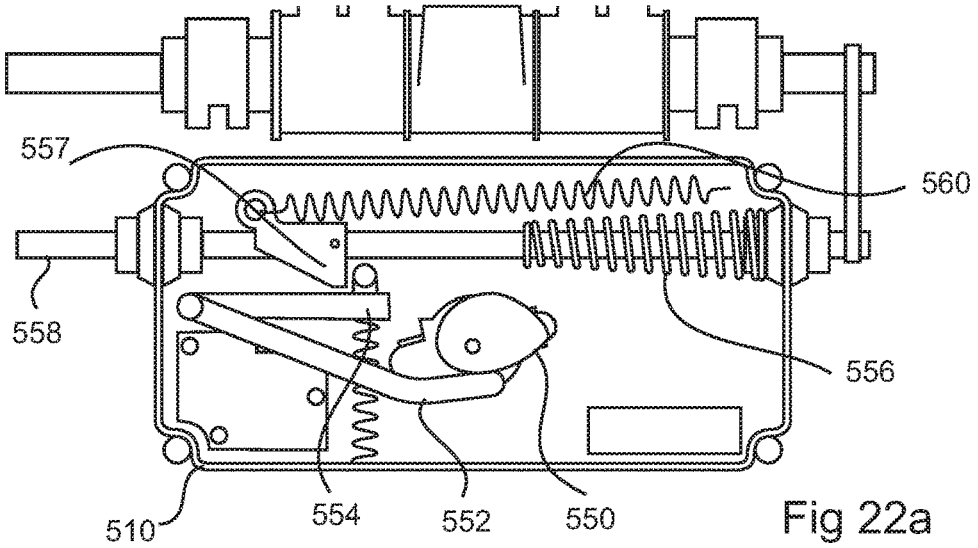
FIGS. 22*a* to 22*e* are sectional views showing steps in the operation of an embodiment of the core marking device.
Figure 22B:
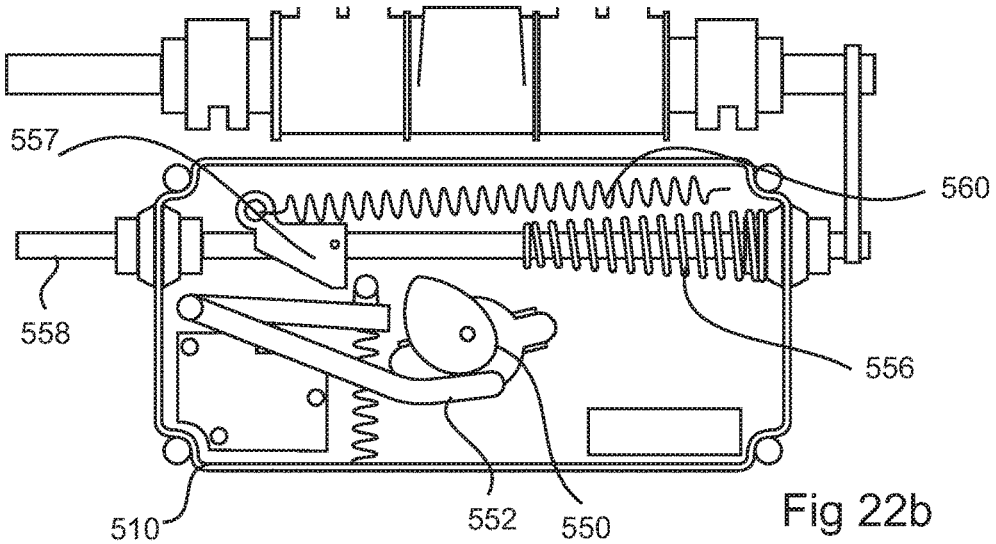
Figure 22C:
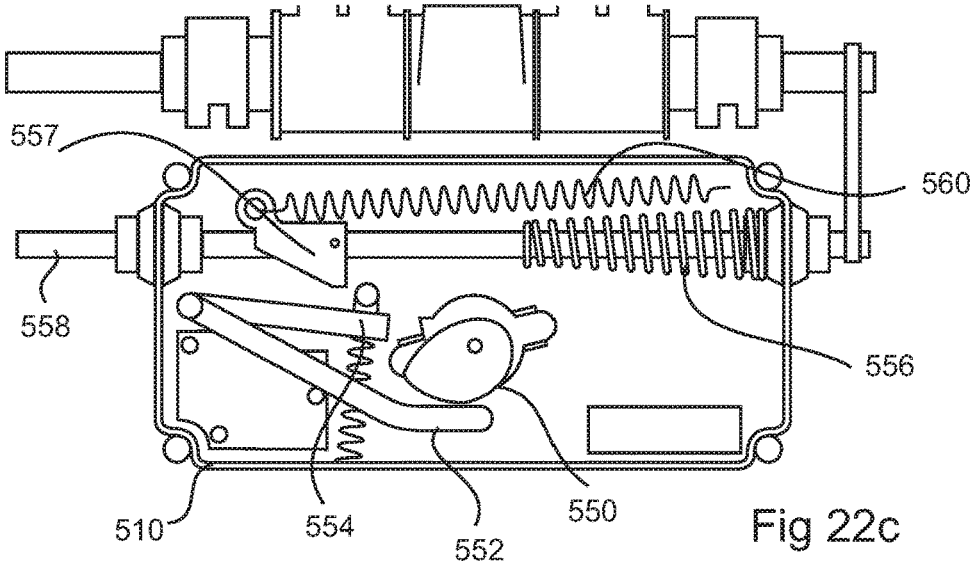
Figure 22D:
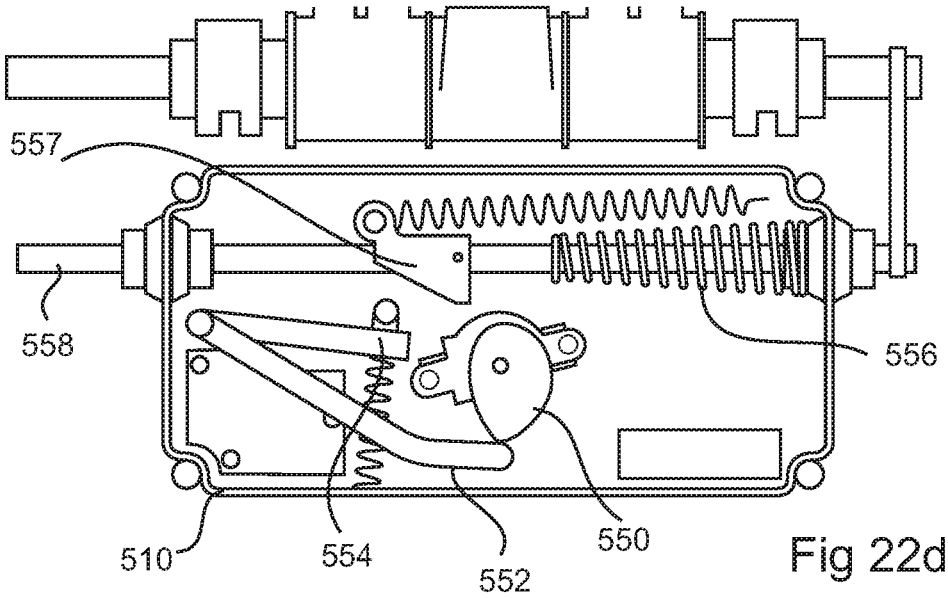
Figure 22E:
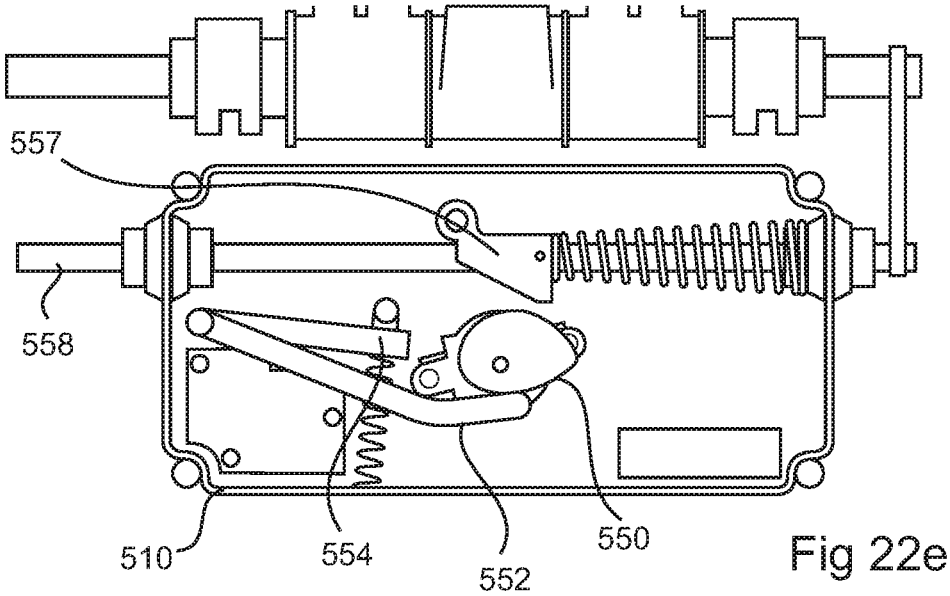

FIGS. 21*a* to 21*c* show an embodiment of the core sample orientation device 510 portion of the system.

There is also an electromechanical releasing device to allow the marking pencil to stamp the core face when required. FIG. 21*c* shows the internal release mechanism. A rotary cam 550 is driven by motor when triggered. The cam acts on the lever arm 552 to retract the spring loaded detent 554. When operated, the retracted detent disengages from a latch 557 allows a spring 560 loaded slide arm 558 (shown in dotted phantom) to release. This causes the marker (e.g. wax pencil) to release and mark the end of the core. A damper spring 556 cushions the end of travel. Resetting is by pulling the latch back.

FIGS. 22*a* to 22*e* show steps in operation of the electromechanical mechanism to release the marker to mark the core. As the cam 550 rotates, the pivoting lever arm 552 is depressed. This retracts the spring loaded detent 554 and releases that detent from engagement with the latch 557. The spring 560 pulls the latch which causes the marker (not shown) to contact the end of the core and mark it.

What is claimed is:

1. A method of determining orientation of a core obtained by drilling the core from a subsurface body of material, the method comprising:

a) recording data relating to orientation of the core to be retrieved, the data recorded using a downhole core orientation data recording device;

b) providing a communication device at the surface having a timer and commencing timing from a specific moment;

c) separating the core from the subsurface body and retrieving the core and the core orientation data recording device to the surface;

d) a period of time after the specific moment, the communication device signalling to the core orientation data recording device at the surface to identify or note core orientation data recorded a period of time that has elapsed since the specific moment such that the timer of the communication device is not synchronized with timing of the recording of the data relating to the orientation of the core; and e) the core orientation data recording device providing the recorded orientation data recorded prior to and closest to the end of the period of time that the communication device has signalled to the data recorder to look back.

2. The method according to claim 1, wherein the communication device signals to the data recording device to halt surveying.

3. The method according to claim 1, further comprising the communication device referring its internal clock and transmits to the data recording device an elapsed time value when the data recording device enters a core orientation process stage.

4. The method according to claim 1, further comprising the data recording device deducting the time value from a predetermined time value of its own internal timer.

5. The method according to claim 1, further comprising the data recording device checking for a saved data event in its memory that occurred previous to time value, and retrieving a core sample roll value.

6. The method according to claim 1, wherein the core orientation data recording device comprises one or more lights or other visual indicators to give an indication of required orientation and/or direction to rotate the core for marking the core.

7. The method according to claim 1, wherein, once in orientate mode, visual indications indicate to an operator to rotate the core to find the correct rotational position for marking the orientation of the core.

8. The method according to claim 1, whereby, once in an orientation mode, visual indications indicate to an operator which direction to rotate the core to find the correct 'down side' of the core for marking the orientation thereof.

9. The method according to claim 1, whereby, communication to the core orientation data recording device is effected via the remote communication device and the remote communication device will then verify that the correct orientation was achieved based on the orientation data recorded.

10. The method according to claim 1, wherein the timer of the remote communication device identifies or marks a time when a user selects that a core sample is to be retrieved.

11. The method according to claim 10, wherein the core orientation data is recorded before or after the specific moment.

12. A system, for determining orientation of a core, which comprises a core orientation data recording device, a remote communication device and a core drilling assembly, wherein the core orientation data recording device is configured to record data relating to orientation of a core to be retrieved, the remote communication device, which is provided at the surface, has a timer configured to commence time from a specific moment, and after the core has been separated from a subsurface body and the core orientation data recording device and the core are retrieved to the surface, a period of time after the specific moment the communication device signals to the core orientation data recording device at the surface to identify or note core orientation data recorded a period of time that has elapsed since the specific moment, and the core orientation data recording device is configured to provide the recorded orientation data recorded prior to and closest to the end of a set period of time that the communication device has signalled to the data recorder to look back.

13. The system according to claim 12, wherein the core orientation data recording device comprises at least one visual indicator that is configured to indicate one or more of a direction to rotate the core to obtain the required orientation or a visual indication to show the required orientation.

14. The system according to claim 13, wherein the at least one visual indicator is arranged and configured to provide a flashing light indication.

15. The system according to claim 14, wherein the at least one visual indicator is arranged and configured to change a rate of flashing of the visual indication as the core orientation data recording device is rotated.

16. The system according to claim 12, wherein the remote communication device is operated to indicate or mark a time when a user selects that a core sample is to be retrieved.

17. The system according to claim 16, wherein the core orientation data recording device records the orientation data before or after the specific moment.

* * * * *